US010323614B2

(12) United States Patent
Ebesu et al.

(10) Patent No.: US 10,323,614 B2
(45) Date of Patent: Jun. 18, 2019

(54) SUPERCHARGED ENGINE

(71) Applicant: Mazda Motor Corporation, Aki-gun, Hiroshima (JP)

(72) Inventors: Hidesaku Ebesu, Hiroshima (JP); Ryotaro Nishida, Hiroshima (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 82 days.

(21) Appl. No.: 15/617,946

(22) Filed: Jun. 8, 2017

(65) Prior Publication Data

US 2017/0363051 A1 Dec. 21, 2017

(30) Foreign Application Priority Data

Jun. 16, 2016 (JP) ..... 2016-120212

(51) Int. Cl.

| | |
|---|---|
| ***F02M 39/02*** | (2006.01) |
| ***F02B 33/38*** | (2006.01) |
| ***F02M 37/06*** | (2006.01) |
| *F02B 39/04* | (2006.01) |
| *F02B 75/20* | (2006.01) |
| *F02B 75/18* | (2006.01) |

(52) U.S. Cl.

CPC ..... *F02M 39/02* (2013.01); *F02B 33/38* (2013.01); *F02B 39/04* (2013.01); *F02B 75/20* (2013.01); *F02B 2075/1816* (2013.01); *F02M 37/06* (2013.01)

(58) Field of Classification Search

CPC ..... F02M 39/02; F02M 37/06; F02B 33/38; F02B 39/04; F02B 75/20; F02B 2075/1816

USPC ..... 60/605.1–612

See application file for complete search history.

(56) References Cited

U.S. PATENT DOCUMENTS

| | | | | |
|---|---|---|---|---|
| 4,702,218 | A * | 10/1987 | Yoshioka | F02B 33/42 123/559.2 |
| 8,826,661 | B2 * | 9/2014 | Takahata | F01D 25/145 123/563 |
| 2010/0242901 | A1 * | 9/2010 | Seto | F02D 13/0207 123/299 |
| 2011/0155109 | A1 * | 6/2011 | Onishi | F02D 35/026 123/568.11 |

(Continued)

FOREIGN PATENT DOCUMENTS

| | | |
|---|---|---|
| JP | S6170541 U | 5/1986 |
| JP | H363720 U | 6/1991 |

(Continued)

*Primary Examiner* — Hoang M Nguyen

(74) *Attorney, Agent, or Firm* — Alleman Hall Creasman & Tuttle LLP

(57) ABSTRACT

A supercharged engine is provided, which includes an engine body having cylinders, an intake passage disposed outside the engine body and connected to the cylinders via intake ports, a supercharger provided in the intake passage and spaced apart from an intake-side side surface of the engine body, the intake-side side surface being connected to the intake passage, and a fuel pump disposed on the intake-side side surface. A portion of the intake passage constitutes an intervening part located between the supercharger and the engine body. The intervening part overlaps with the fuel pump in one of vertical and lateral directions of the engine body.

3 Claims, 15 Drawing Sheets

(56) References Cited

U.S. PATENT DOCUMENTS

2013/0192224 A1* 8/2013 Bisaiji ..... F02D 41/10
60/605.2

FOREIGN PATENT DOCUMENTS

| | | | |
|---|---|---|---|
| JP | H08144774 | A | 6/1996 |
| JP | 2005351163 | A | 12/2005 |
| JP | 2014025476 | A | 2/2014 |

* cited by examiner

SUPERCHARGED ENGINE

BACKGROUND

The present invention relates to a supercharged engine.

For example, JP2014-025476A discloses an engine having a supercharger and fuel system components (top injectors) all of which are disposed on a front side of an engine body, and the fuel system components are located above the supercharger to be spaced therefrom.

Incidentally, when a supercharger and a fuel system component, such as a fuel pump, are to be disposed on the same side of an engine body, in consideration of the influence of heat damage, etc., the two components may be disposed on an intake side of the engine body. If a vehicle equipped with the engine having such a structure receives a collision load, the supercharger may move in relation to the vehicle and come in contact with the fuel pump. Therefore, the fuel pump is required to be protected from the supercharger in order to ensure more safety.

For this, the fuel pump and the supercharger may be spaced apart from each other as described in JP2014-025476A, but such a structure is inconvenient for reducing the size of the engine. Especially when the fuel pump is disposed above the supercharger as in the structure of JP2014-025476A, the fuel pump approaches an engine hood by the spaced distance, which causes an inconvenience in that if the hood is deformed by the collision load, the deformed hood may contact the fuel pump. Even if the hood is sufficiently spaced apart from the fuel pump, the position of the hood from the ground becomes relatively high, which lowers aerodynamic characteristics of the vehicle, and as a result, a traveling resistance increases.

SUMMARY

The present invention is made in view of the above issues and aims to provide a supercharged engine having a supercharger and a fuel pump disposed on the same side of an engine body, which protects the fuel pump from the supercharger while achieving an engine size reduction.

According to one aspect of the invention, a supercharged engine is provided, which includes an engine body having cylinders, an intake passage disposed outside the engine body and connected to the cylinders via intake ports, a supercharger provided in the intake passage and spaced apart from an intake-side side surface of the engine body, the intake-side side surface being connected to the intake passage, and a fuel pump disposed on the intake-side side surface.

A portion of the intake passage constitutes an intervening part located between the supercharger and the engine body. The intervening part overlaps with the fuel pump in one of vertical and lateral directions of the engine body.

According to the structure, the supercharger is disposed such that, for example, an engine body side of the supercharger is spaced apart from the intake-side side surface of the engine body, and the intervening part, which is a part of the intake passage, is located between the supercharger and the engine body. Thus, for example, when the supercharger receives a collision load, an approach between the supercharger and the engine body is limited by the intervening part.

In addition, the intervening part overlaps with the fuel pump in one of the vertical and lateral directions of the engine body. Such an arrangement locates the fuel pump between the supercharger and the engine body when the engine is seen in the vertical or lateral directions, similar to the intervening part. Therefore, the limitation of the approach between the supercharger and the fuel pump by the intervening part prevents contact between the supercharger and the fuel pump, which leads to protecting the fuel pump from the supercharger.

Further, according to the above structure, the supercharger and the fuel pump may be brought close to each other in the vertical directions without separating them from each other as disclosed in JP2014-025476A, which is effective in reducing the size of the engine.

Thus, according to the above structure, the fuel pump is protected from the supercharger while reducing the size of the engine.

Moreover, according to the above structure, by having a portion of the intake passage as the intervening part, the fuel pump is protected from the supercharger without providing another member, which is effective in reducing the number of components of the engine.

The intervening part may be formed by a portion of the intake passage downstream of the supercharger.

The portion of the intake passage downstream of the supercharger includes a passage connected to the engine body. Disposing such a passage near the engine body is advantageous in reducing the size of the engine.

The intake passage may have a relay part constituting a passage downstream of the supercharger and upstream of the intervening part. The relay part may be connected to a part of the supercharger on a side opposite from the engine body.

According to the structure, when the collision load is received from the opposite side of the engine body, the load is added to the supercharger via the relay part. Since the relay part is a hollow member, it crushes according to the magnitude of the load. By crushing the relay part, the impact applied to the supercharger itself is subsided. Thus, a relative movement of the supercharger is reduced, which becomes advantageous in reliably protecting the fuel pump.

The supercharger may be fastened to the intervening part.

According to the structure, the intervening part supports the supercharger. Therefore, when the collision load is applied to the supercharger, the approach between the supercharger and the engine body is limited more reliably by the intervening part, which is advantageous in reliably protecting the fuel pump.

The supercharger may extend along the intake-side side surface. The supercharger may be fastened to the intervening part at two opposite end sides.

According to the structure, the supercharger is stably supported. Therefore, the approach between the supercharger and the engine body is stably limited, which is advantageous in reliably protecting the fuel pump.

DETAILED DESCRIPTION OF EMBODIMENTS

Hereinafter, some embodiments of a supercharged engine according to the present invention are described with reference to the accompanying drawings. Note that the following embodiments are merely examples.

Entire Structure of Engine

Figure 1:
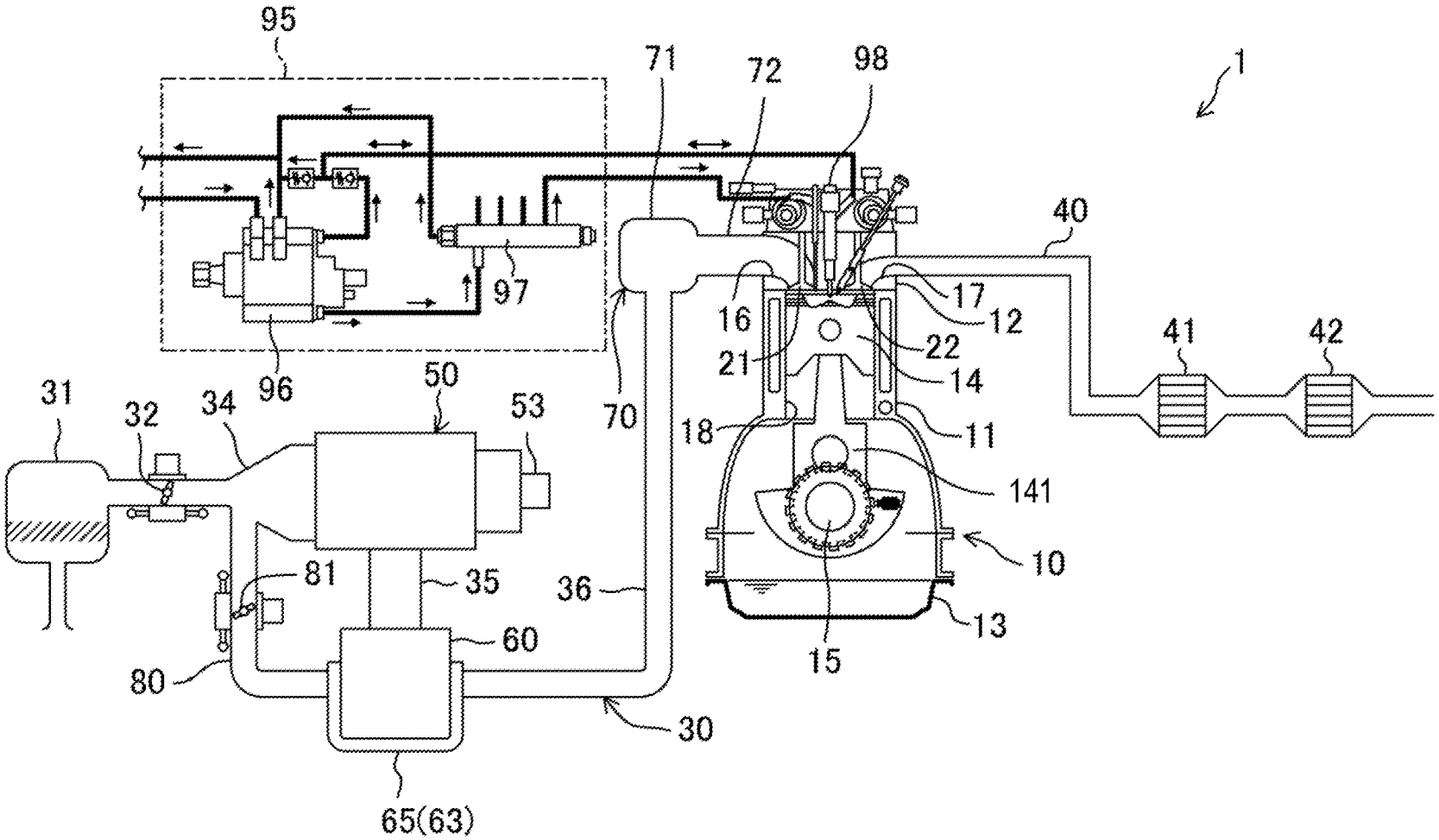
FIG. 1 is a schematic view of a part of a structure of a supercharged engine according to one embodiment of the present invention.
Figure 2:
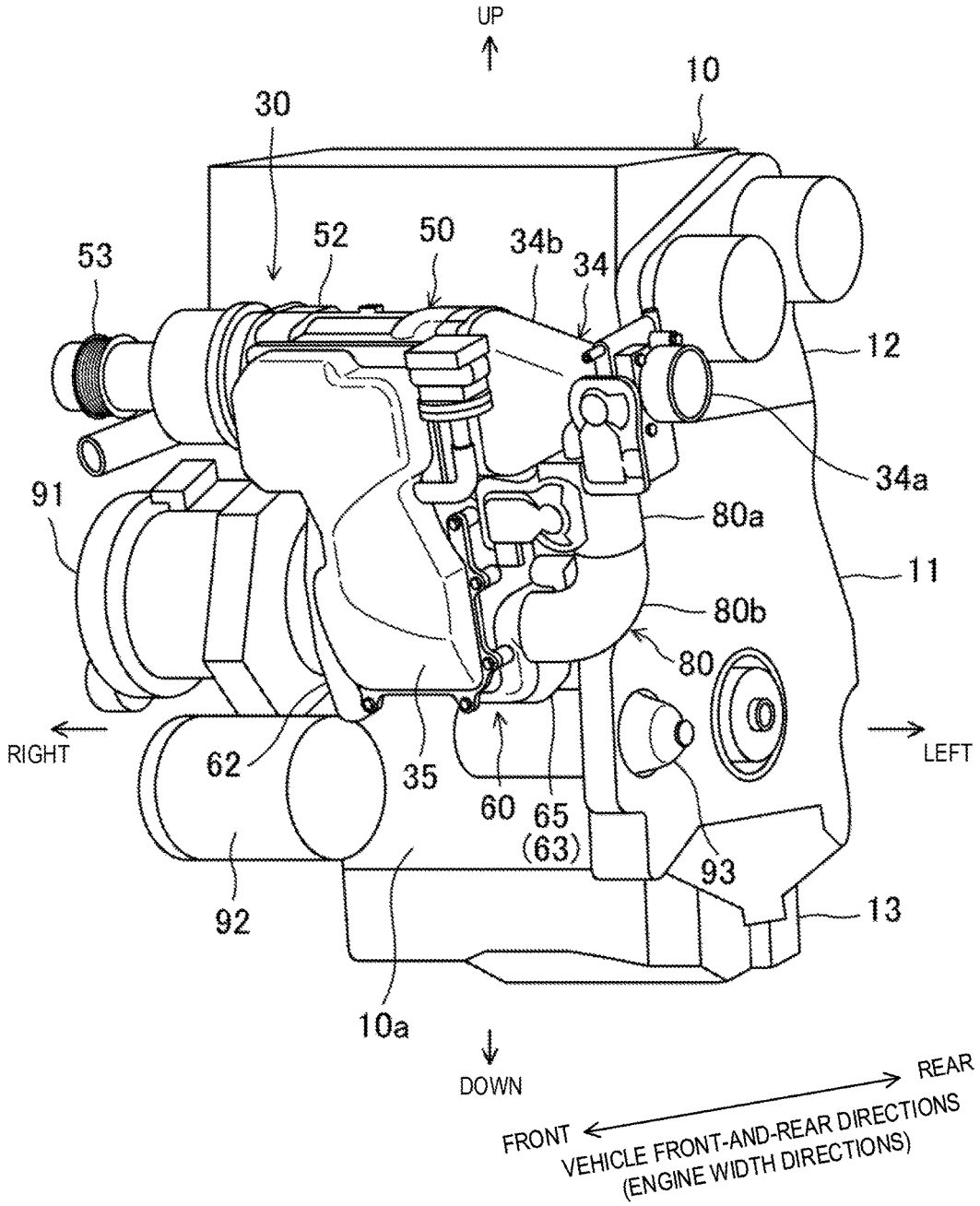
FIG. 2 is a perspective view of the supercharged engine.
Figure 3:
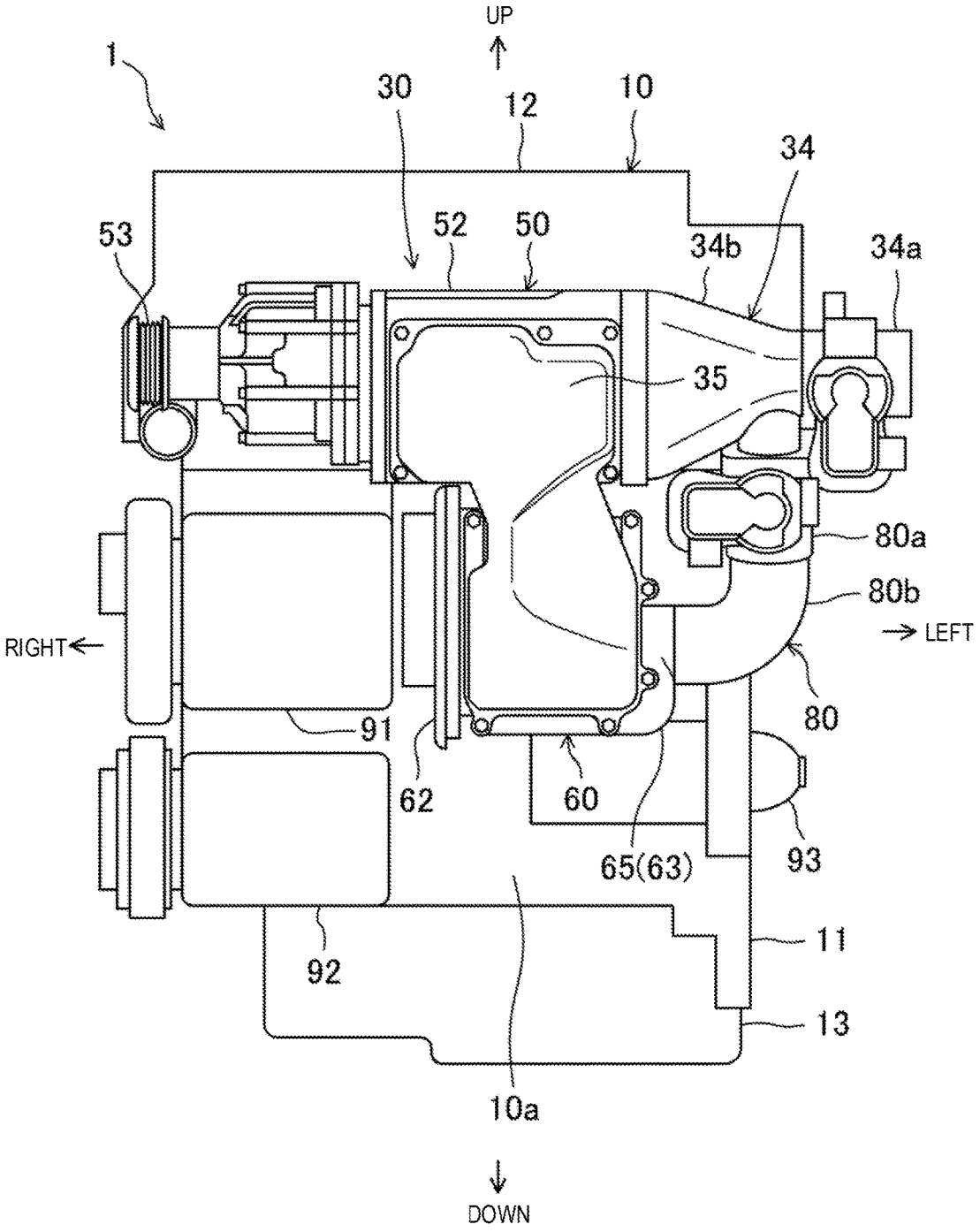
FIG. 3 is a front elevational view of the supercharged engine.
Figure 4:
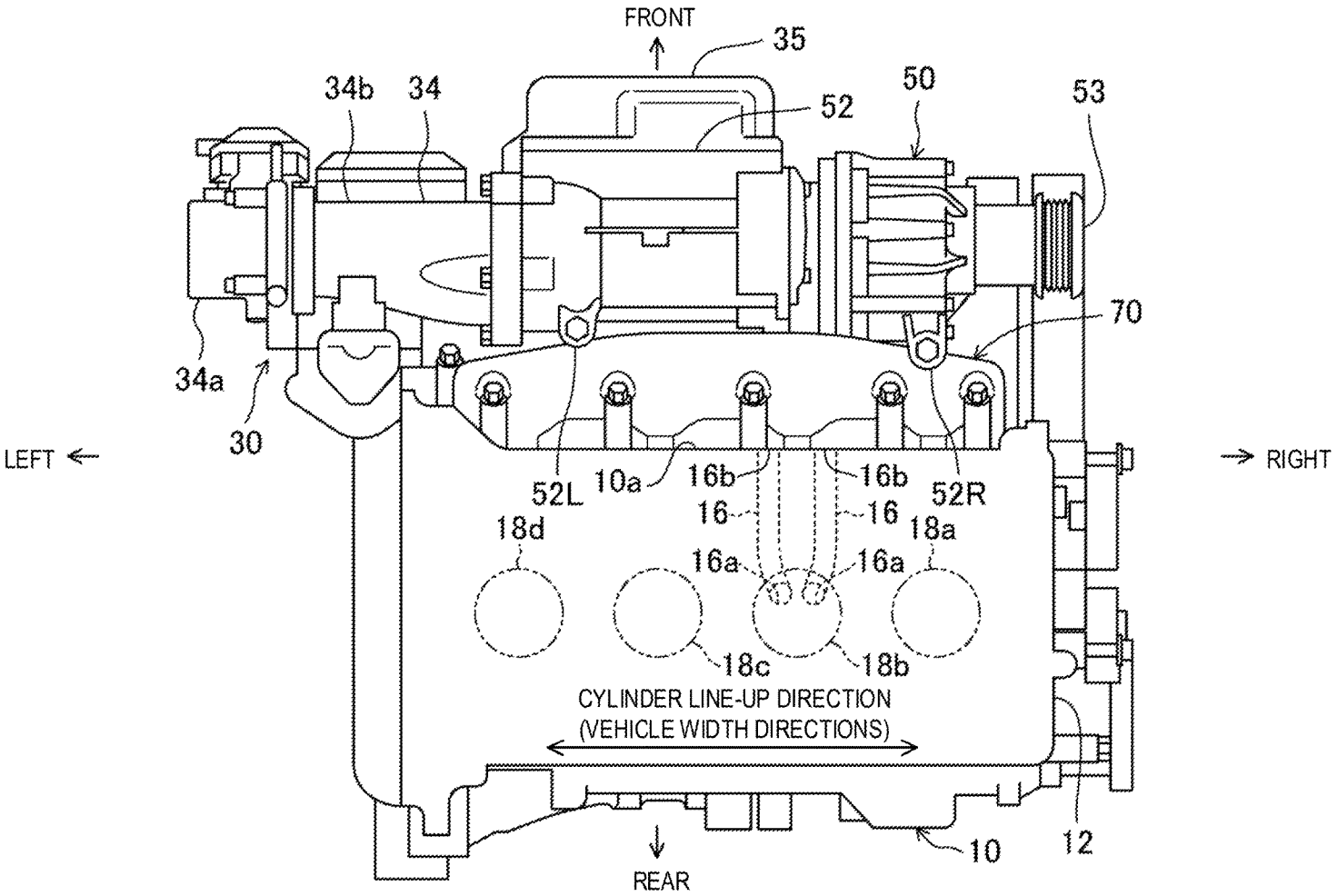
FIG. 4 is a plan view of the supercharged engine.

FIG. 1 illustrates a schematic structure of a supercharged engine (hereinafter, simply referred to as "the engine") according to one embodiment of the present invention. FIG. 2 is a perspective view of the engine. FIG. 3 is an elevational view of the engine. FIG. 4 is a plan view of the engine. The engine 1 is a gasoline engine mounted on a vehicle with a front-engine front-drive layout, and as illustrated in FIGS. 1 to 3, includes a mechanically-driven forced induction system (a so-called supercharger) 50.

As illustrated in FIG. 4, the engine 1 includes four cylinders 18 arranged in line, and is a so-called transverse, inline four-cylinder engine in which the four cylinders 18 align in vehicle width (lateral) directions. Thus, in this embodiment, longitudinal directions of the engine which are in parallel to the arranged direction of the four cylinders 18 (cylinder line-up direction) substantially match with the vehicle lateral directions, and width directions of the engine substantially match with longitudinal directions of the vehicle. Hereinafter, unless otherwise specified, "front side" means one side in the engine width directions (an intake side of the engine, and in the transverse engine, a front side in the vehicle longitudinal directions), and "rear side" means the other side in the engine width directions (an exhaust side of the engine, and in the transverse engine, a rear side in the vehicle longitudinal directions). Further, "left side" means one side in the engine longitudinal directions (one side in the cylinder line-up direction, and in the transverse engine, a left side in the vehicle lateral directions), and "right side" means the other side in the engine longitudinal directions (the other side in the cylinder line-up direction, and in the transverse engine, a right side in the vehicle lateral directions). Moreover, "upper side" means one side in engine vertical directions perpendicular to the engine width directions and the engine longitudinal directions, and "lower side" means the other side in the engine vertical directions.

As illustrated in FIG. 1, the engine 1 mainly includes an engine body 10 having the four cylinders 18 (only one cylinder is illustrated in FIG. 1), an intake passage 30 disposed on the front side (outside) of the engine body 10 and connected to the respective cylinders 18 via intake ports 16, an exhaust passage (only illustrated in FIG. 1) 40 disposed on the rear side of the engine body 10 and connected to the respective cylinders 18 via exhaust ports 17 (so-called front-intake, rear-exhaust engine). The supercharger 50 is disposed in the intake passage 30. As illustrated in FIGS. 2 and 3, the intake side (front side) of the engine body 10 is also provided with, in addition to the intake passage 30, a drive pulley 53 for the supercharger 50, an alternator 91 for generating an alternating current used in an electric system, an air compressor 92 for air conditioning, a starter motor 93 for driving the engine body 10 until a complete combustion is performed at the time of an engine start, a fuel pump 96 constituting a fuel supply system 95, etc.

The engine body 10 combusts inside the cylinders 18 a mixture gas containing the intake air supplied from the intake passage 30 and fuel. For example, the engine body 10 includes a cylinder block 11 provided with the four cylinders 18, a cylinder head 12 assembled on the cylinder block 11, and an oil pan 13 disposed below the cylinder block 11 and storing a lubricant. A reciprocatable piston 14 coupled to a crankshaft 15 via a connecting rod 141 is fitted into each of the cylinders 18.

In the cylinder block 11, the four cylinders 18 are arranged in line. In the following description, the four cylinders 18 illustrated in FIG. 4 may be referred to as the first cylinder 18*a*, the second cylinder 18*b*, the third cylinder 18*c*, and the fourth cylinder 18*d* in this order from the right side in the cylinder line-up direction.

In the cylinder head 12, two intake ports 16 and two exhaust ports 17 are formed for each of the cylinders 18, each of the intake ports 16 is provided with an intake valve 21 for opening and closing the intake port 16 at the cylinder 18 side and each of the exhaust ports 17 is provided with an exhaust valve 22 for opening and closing the exhaust port 17 at the cylinder 18 side. FIG. 4 illustrates a structure of the intake ports 16 of the second cylinder 18*b*. For example, the cylinder head 12 of this embodiment is provided, for each of the cylinders 18, with two intake apertures 16*a* opening to the cylinder 18 and the two intake ports 16 attached to a downstream end (specifically, independent passages 72) of the intake passage 30 and connecting the downstream end to the intake apertures 16*a*. Upstream ends 16*b* of the intake ports 16 open at an attaching surface 10*a* (described later) and are arranged in the cylinder line-up direction. A distribution passage 70 extends in the cylinder line-up direction to communicate with the upstream ends 16*b* of the intake ports 16 of the respective cylinders 18 and to cover the upstream ends 16*b*. The intake valves 21 for opening and closing the eight intake ports 16 are driven by an intake camshaft provided to the cylinder head 12. For example, when the intake camshaft rotates, the rotational force acts on upper end portions of the intake valves 21 via cams of the intake camshaft to drive the intake valves 21 to open and close the intake apertures. The corresponding components on the exhaust side are also driven in a similar manner.

An injector 98 for injecting the fuel supplied from a fuel tank into the cylinder 18 is attached to the cylinder head 12 for each cylinder 18. The fuel tank is connected to the injectors 98 by a fuel supply path. The fuel supply path is provided with a fuel supply system 95 including the fuel pump 96 and a common rail 97, and for supplying the fuel to the injectors 98 at a relatively high pressure. The fuel pump 96 sends the fuel from the fuel tank to the common rail 97, and the common rail 97 stores the sent fuel at a relatively high pressure. When the injectors 98 open, the fuel stored in the common rail 97 is injected from injection ports of the injectors 98.

The intake passage 30 allows externally introduced intake air (fresh air) to pass therethrough and supplies it to the cylinders 18 of the engine body 10. For example, an air cleaner 31 (only illustrated in FIG. 1) for purifying the intake air introduced externally, a throttle valve 32 for adjusting a flow rate of the intake air passing therethrough, the mechanically driven supercharger 50 for compressing the intake air, and an intercooler 60 for adjusting a temperature of the intake air, are disposed in the intake passage 30 in this order from an upstream side of the intake flow.

The downstream end of the intake passage 30 is formed by the distribution passage 70 for supplying the intake air to the cylinders 18. The distribution passage 70 has a surge tank 71 for temporarily storing air, and the independent passages 72 for distributing the air stored in the surge tank 71 to the cylinders 18, respectively.

Further, the intake passage 30 has passages to connect various parts with each other. The passages include a first passage 34 for leading the intake air purified by the air cleaner 31 to the supercharger 50, a second passage 35 for leading the intake air compressed by the supercharger 50 to the intercooler 60, and a third passage 36 for leading the air passed through the intercooler 60 to the distribution passage 70.

The intake passage 30 is branched on the upstream side of the supercharger 50 and merges again on the downstream side of the supercharger 50 and the intercooler 60. For example, the intake passage 30 is provided with a bypass passage 80 connecting a portion of the intake passage 30 between the throttle valve 32 and the supercharger 50 with a portion of the intake passage 30 between the intercooler 60 and the distribution passage 70. A bypass valve 81 for opening and closing the bypass passage 80 is disposed in the bypass passage 80.

The exhaust passage 40 discharges exhaust gas generated in the cylinders 18 to the outside thereof. For example, an upstream portion of the exhaust passage 40 is formed by an exhaust manifold (not illustrated) having independent passages extending toward the cylinders 18 and connected to external ends of the exhaust ports 17, and a manifold section where the independent passages are collected together. Exhaust purifying catalysts 41 and 42 for purifying hazardous components within the exhaust gas are connected to the exhaust passage 40 on the downstream side of the exhaust manifold.

Hereinafter, the structure of the intake side (front side), i.e., the intake system of the engine 1, particularly the three-dimensional structure of the intake passage 30, and the arrangement of peripheral components thereof are described.

Intake System Structure

Figure 5:
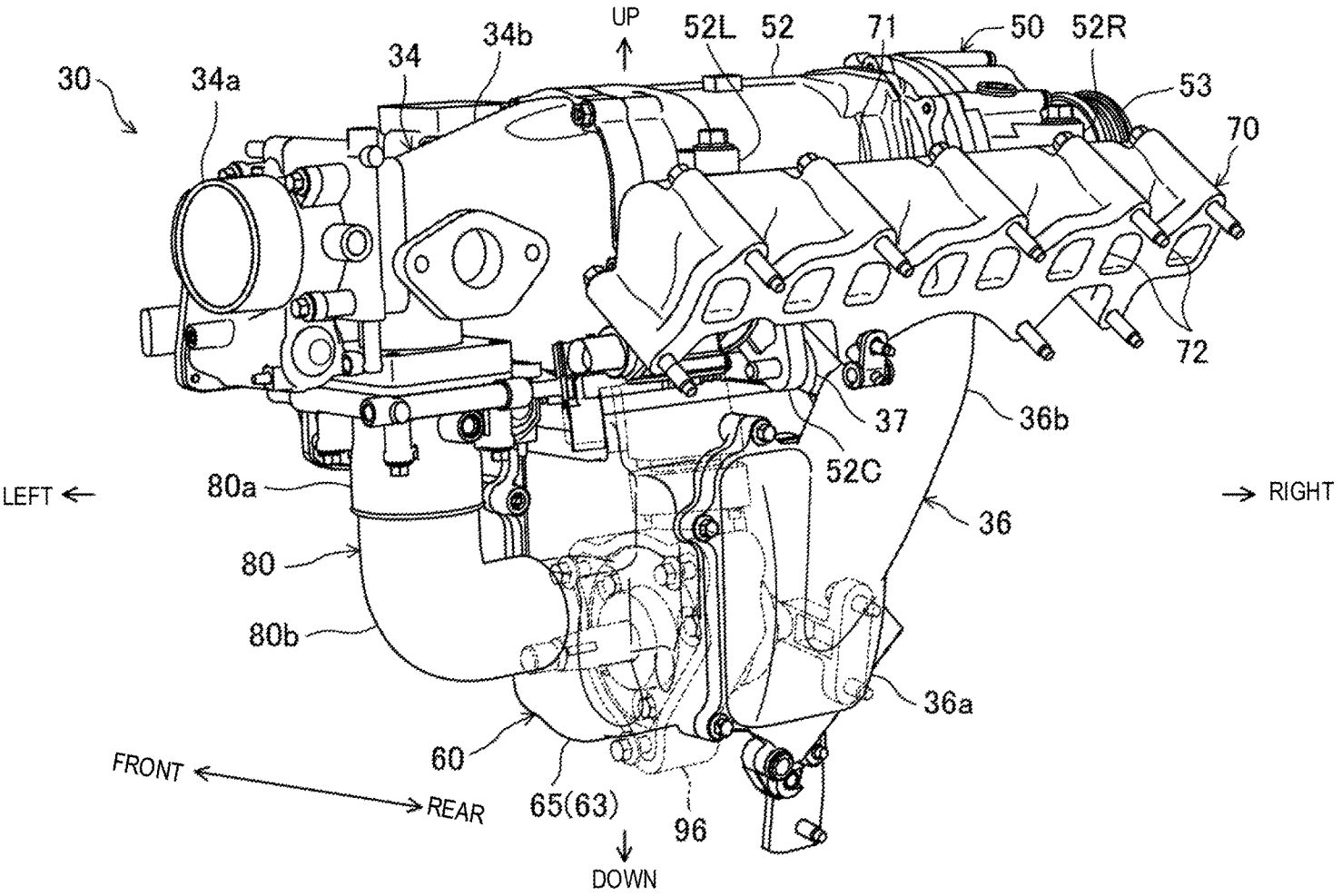
FIG. 5 is a perspective view illustrating the entire structure of an intake passage.
Figure 6:
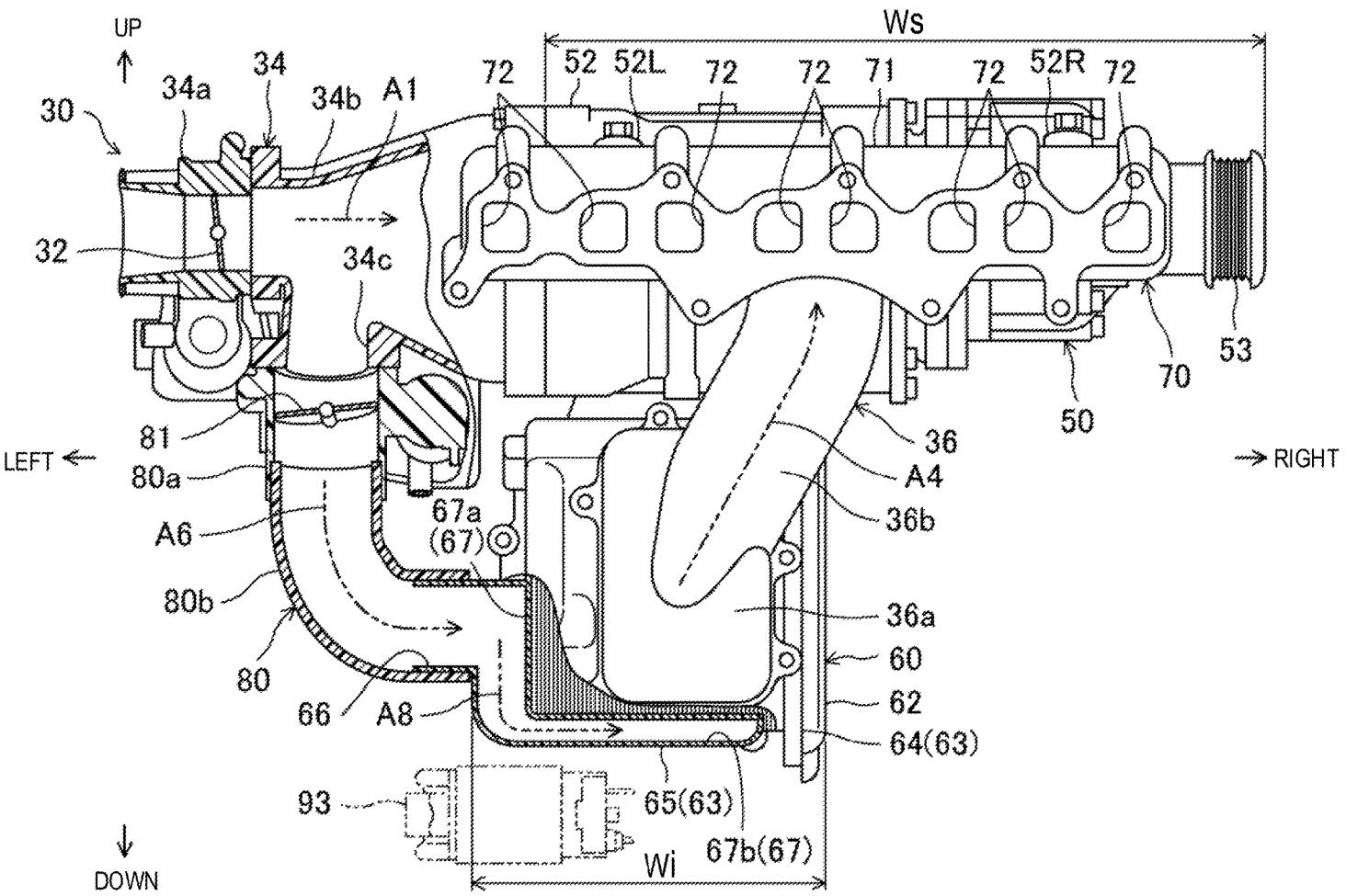
FIG. 6 is a partially-cutaway rear elevational view illustrating the structure of the intake passage.
Figure 7:
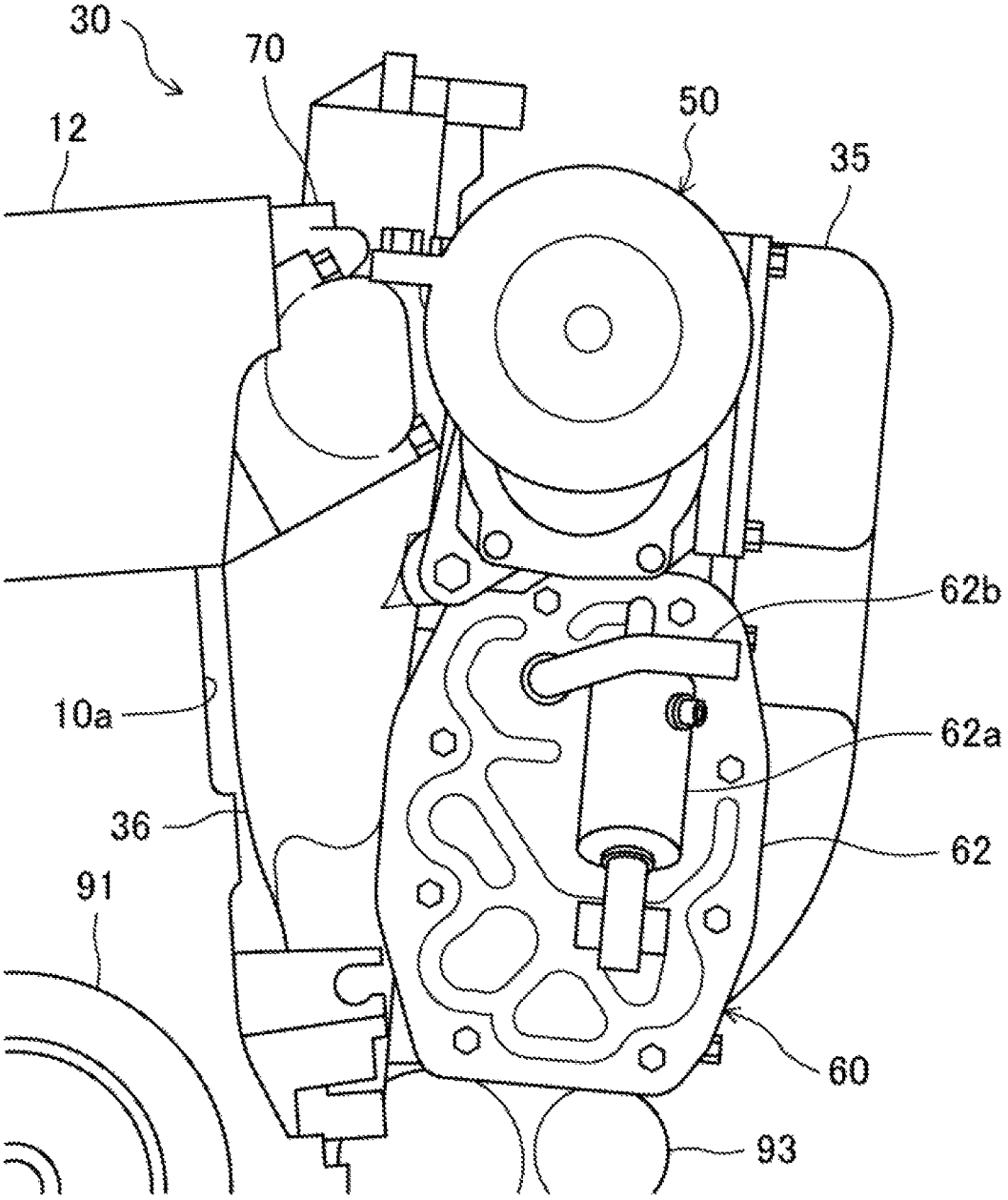
FIG. 7 is a side view of the intake passage.
Figure 8:
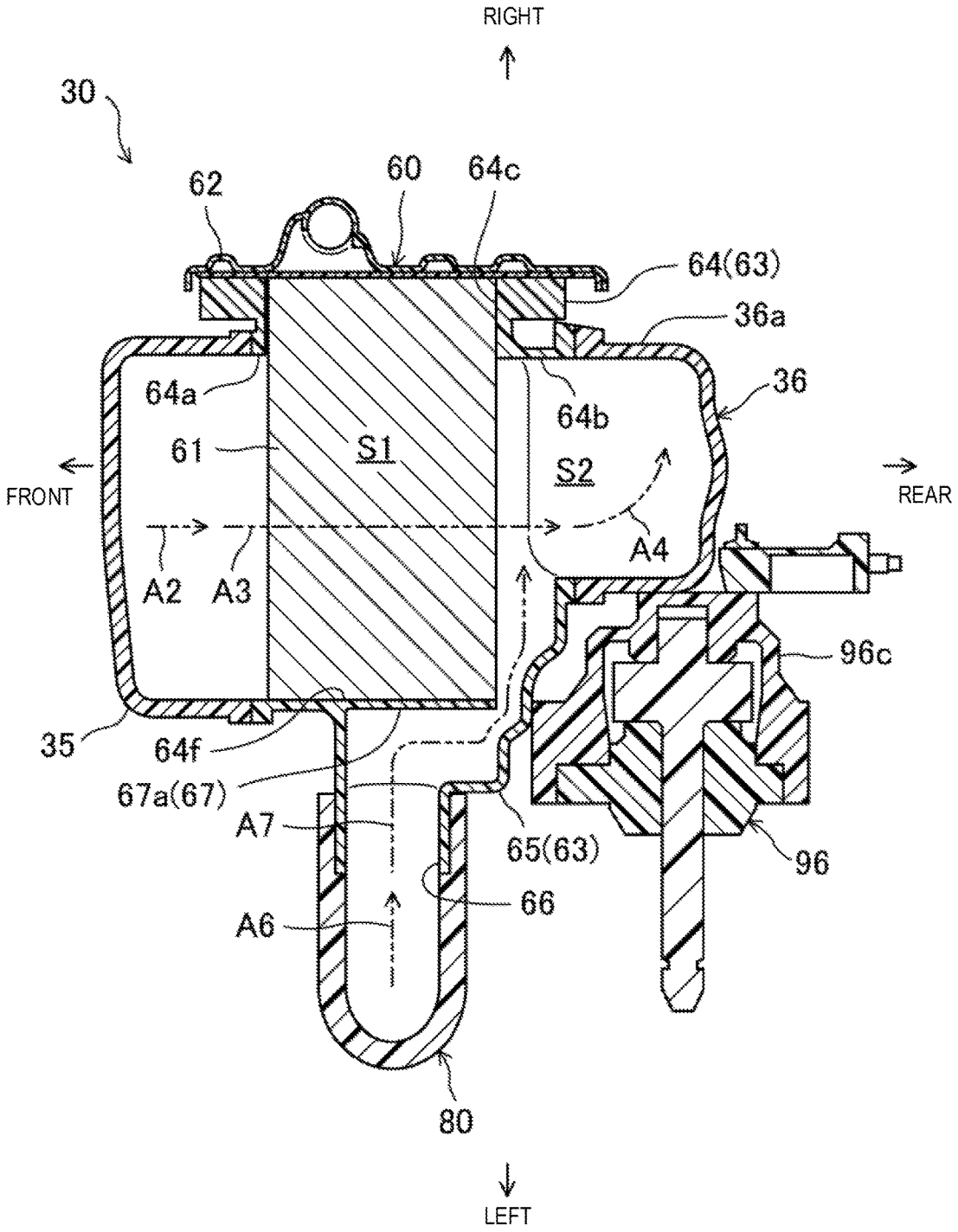
FIG. 8 is a horizontal cross-sectional view of the intake passage.
Figure 9:
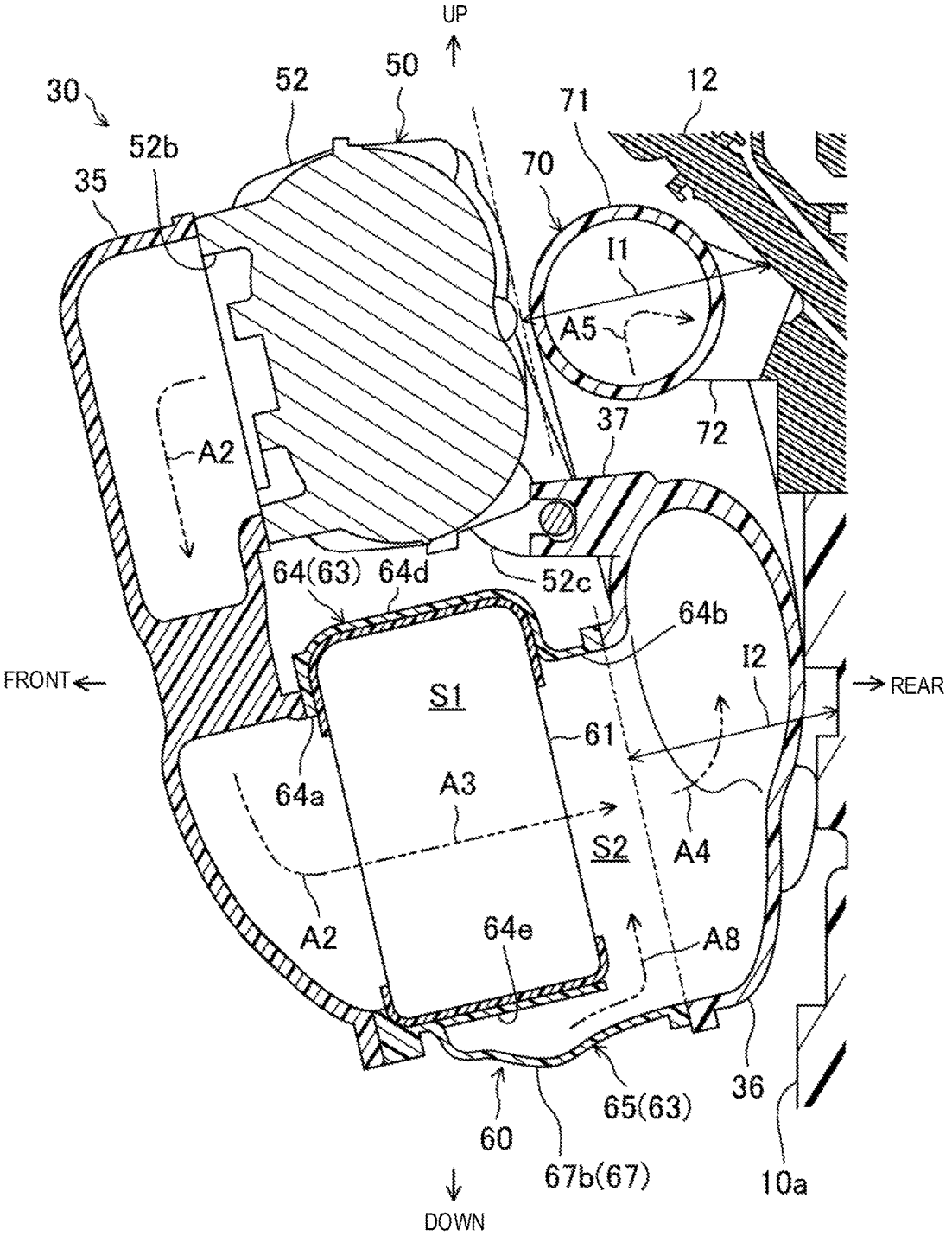
FIG. 9 is a vertical cross-sectional view of the intake passage.

FIG. 5 is a perspective view illustrating the structure of the intake passage 30. FIG. 6 is a partially-cutaway rear elevational view illustrating the structure of the intake passage 30. FIG. 7 is a side view of the intake passage 30. FIG. 8 is a horizontal cross-sectional view of the intake passage 30. FIG. 9 is a vertical cross-sectional view of the intake passage 30 seen in the crankshaft axial directions.

The various parts constituting the intake passage 30 are all disposed on the front side of the engine body 10, more specifically, on a side (in front) of a front surface 10*a* of the engine body 10 (see FIGS. 2 to 4 and 12). Hereinafter, the front surface 10*a* which is the intake-side side surface of the engine body 10 (specifically, a side surface of the engine body 10 to which the intake passage 30 is connected) is referred to as the attaching surface 10*a*. As illustrated in FIG. 3 etc., the attaching surface 10*a* is formed by the cylinder block 11 and a front surface of the cylinder head 12. As described later, the supercharger 50 is attached to the attaching surface 10*a* with a given space 11, thus a gap is provided between a rear surface of the supercharger 50 and the attaching surface 10*a*. The first passage 34 extends in the cylinder line-up direction on the left side of the supercharger 50, and is connected to a left end of the supercharger 50. Further, the intercooler 60 is adjacently disposed on the vertically lower side (direction of gravity) of the supercharger 50 and is disposed with a given space I2 from the attaching surface 10*a*, similar to the supercharger 50. The intercooler 60 is also disposed in parallel to the fuel pump 96. The second passage 35 vertically extends to connect a front part of the supercharger 50 with a front part of the intercooler 60. The distribution passage 70 is located in the gap between the supercharger 50 and the attaching surface 10*a*, and the third passage 36 extends along the gap between the part extending from the supercharger 50 to the intercooler 60 and the attaching surface 10*a* so as to connect the distribution passage 70 with the intercooler 60. The bypass passage 80 extends downwardly from an intermediate position of the first passage 34 and then extends inwardly (rightwardly) toward the engine body 10 to be connected to a left part of the intercooler 60.

Next, the structure and arrangement of the various parts are described in detail.

The first passage 34 is generally formed in a tubular shape extending in the left-and-right directions, and an upstream end (left end) thereof is formed by a throttle body 34*a* built therein with the throttle valve 32. As illustrated in FIGS. 3 to 6, etc., the throttle body 34*a* is made of metal, formed in a short cylindrical shape, and located at a position leftward and forward of the attaching surface 10*a* in a posture opening to the left and right at two opposite ends. The upstream end (left end) of the throttle body 34*a* is connected to the air cleaner 31 via a given passage (not illustrated), and a downstream end (right end) of the throttle body 34*a* is connected to a first passage main body 34*b* constituting another part of the first passage 34.

As illustrated in FIGS. 3 to 6, the first passage main body 34*b* connects the throttle body 34*a* with the supercharger 50. For example, the first passage main body 34*b* is made of resin, formed in a long tubular shape, and arranged to open to the left and right at two opposite ends. The first passage main body 34*b* is coaxially disposed with the throttle body 34*a*, on the front side of an upper left part of the attaching surface 10*a*. For example, as illustrated in FIG. 6, the diameter of the first passage main body 34*b* increases toward the inner side in the cylinder line-up direction (toward the right side). An upstream end (left end) of the first passage main body 34*b* is connected to the downstream end of the throttle body 34*a*, and a downstream end (right end) of the first passage main body 34*b* is connected to a suction port of the supercharger 50.

The first passage main body 34*b* is formed with a branch part 34*c* branching into the bypass passage 80. As illustrated in FIG. 6, the branch part 34*c* is formed in a lower surface of an upstream portion of the first passage main body 34*b*, and is connected to an upstream end of the bypass passage 80. As illustrated in FIGS. 4 to 6, etc., the branch part 34*c* is disposed at a position on the outer side (left side) in the vehicle width directions, of the supercharger 50, the intercooler 60, the eight intake ports 16, and the distribution passage 70 connected to the intake ports 16.

Therefore, the intake air purified by the air cleaner 31 and flowed into the first passage 34 passes through the throttle valve 32, and then either is sucked into the supercharger 50 from the downstream end of the first passage main body 34*b* (see an arrow A1 in FIG. 6) or flows into the bypass passage 80 via the branch part 34*c* at the intermediate position of the first passage main body 34*b*.

The supercharger 50 is configured as a roots-type supercharger. For example, the supercharger 50 has a pair of rotors (not illustrated) having a rotation shaft extending in the cylinder line-up direction, a casing 52 accommodating the rotors, and the drive pulley 53 for rotating the rotors. The supercharger 50 is drivably coupled to the crankshaft 15 via a drive belt (not illustrated) wrapped around the drive pulley 53.

The casing 52 extends along the attaching surface 10*a* in the left-and-right directions, and forms an accommodation space for the rotors and a flow path of the intake air in the supercharger 50. For example, the casing 52 is made of metal, formed in a rectangle tubular shape opening at a left end and a front surface, and as illustrated in FIG. 4 etc., the casing 52 has the given space 11 (see FIG. 9) from a position above a substantially center of the attaching surface 10*a* in the left-and-right directions, and is coaxially disposed with the first passage 34. A left end part of the casing 52 in its longitudinal directions is formed with a suction port for sucking the intake air to be compressed by the rotors, and the downstream end (right end) of the first passage 34 is connected to the suction port. On the other hand, as illustrated in FIG. 9, the front surface (the side opposite from the engine body 10) of the casing 52 is formed with a discharge port 52*b* for discharging the intake air compressed by the rotors, and an upstream end of the second passage 35 is connected to the discharge port 52*b*.

Here, as illustrated in FIGS. 4 to 6, the supercharger 50 is fastened to the distribution passage 70 at both end sides in longitudinal directions (left and right end sides). For example, a right end side bracket 52R having a bolt insertion hole is provided to protrude in a right end part of a rear surface (a side surface on the engine body side) of the casing 52. A left end side bracket 52L having a similar structure as the right end side bracket 52R is provided to protrude in a left end part of the rear surface of the casing 52. The bolt insertion holes of both the right and left end side brackets 52R and 52L allow bolts to pass therethrough from the upper side (see also FIG. 14).

Additionally, as illustrated in FIGS. 5 and 9, the supercharger 50 is also fastened to the third passage 36. For example, a pair of center brackets 52C are provided to protrude in substantially a center part of the rear surface of the casing 52 in the left-and-right directions, and spaced apart from each other in the left-and-right directions. Each center bracket 52C has a bolt insertion hole. The bolt insertion hole of each center bracket 52C is formed so that a bolt is inserted thereinto in the left-and-right directions. One of the brackets 52C supports a base end portion of the inserted bolt and the other bracket 52C supports a tip portion of the same bolt.

The drive pulley 53 rotates the rotors accommodated in the casing 52. For example, the drive pulley 53 is formed into a shaft protruding from a right end of the casing 52 and extending substantially coaxially with the first passage 34 and the casing 52. A drive belt is wrapped around a tip part of the drive pulley 53, and as described above, drivably couples the crankshaft 15 to the supercharger 50.

Therefore, during operation of the engine 1, an output from the crankshaft 15 is transmitted via the drive belt and the drive pulley 53 to rotate the rotors. The rotation of the rotors causes compression of the intake air sucked from the first passage 34 and discharge thereof from the discharge port 52*b*. The discharged intake air flows into the second passage 35 disposed on the front side of the casing 52.

The second passage 35 connects the supercharger 50 with the intercooler 60 as illustrated in FIGS. 2, 3, 9, 14, etc. As described above, since the supercharger 50 and the intercooler 60 are disposed vertically adjacent to each other, the second passage 35 of this embodiment extends in the up-and-down directions. The second passage 35 is formed such that both upper and lower ends thereof curve to the engine body side (rear side). An upper end of the second passage 35 is connected to the front part (discharge port 52*b*) of the casing 52 of the supercharger 50, and a lower end thereof is connected to the front part of the intercooler 60. For example, as illustrated in FIGS. 2 and 9, the second passage 35 is formed as a curved tube having a flat shape in the left-and-right directions, is made of resin, extending downwardly from the discharge port 52*b* of the casing 52 while curving to convex to the opposite side (front side) of the engine body 10, and is connected to the front part of the intercooler 60. Further, a portion of the second passage 35 near its upper end extends to cover a part of a front surface of the supercharger 50, and thus the upper end of the second passage 35 forms a space in front of the supercharger 50. Similarly, a portion of the second passage 35 near its lower end extends to cover a part of a front surface of the intercooler 60, and thus the lower end of the second passage 35 forms a space in front of the intercooler 60. Note that the second passage 35 is a portion of the intake passage 30 downstream of the supercharger 50 and upstream of the distribution passage 70, and constitutes the "relay part" of this embodiment.

Thus, as indicated by an arrow A2 in FIG. 9, the intake air which flows from the supercharger 50 into the second passage 35 flows forwardly from the supercharger 50, downwardly along the second passage 35, and then rearwardly to the intercooler 60. The intake air passed through the second passage 35 flows into the intercooler 60 from the front side.

Further, since the second passage 35 connects the supercharger 50 with the intercooler 60, a relative movement of the supercharger 50 and the intercooler 60 to each other in the up-and-down directions is limited.

As illustrated in FIGS. 7, 8, etc., the intercooler 60 is configured as a water-cooled intercooler, and includes a core 61 having an intake air cooling function, a core connecting part 62 supporting a water supply pipe 62*a* for introducing cooling water into the core 61 and supporting a drain pipe 62*b* for leading out the cooling water from the core 61, and a cooler housing 63 for accommodating the core 61. The core connecting part 62 is attached to a side part of the core 61.

Note that as illustrated in FIG. 6, a dimension Wi of the intercooler 60 in width directions of the intercooler 60 (left-and-right directions) is shorter than a dimension Ws of the supercharger 50 in the width directions.

As illustrated in FIGS. 8, 9, etc., the core 61 is formed in a cuboid shape and arranged so that one side surface (rear surface) thereof faces the attaching surface 10*a*. A front surface of the core 61 constitutes an entrance surface for the intake air, whereas a rear surface of the core 61 forms an exit surface for the intake air. Both of these surfaces are largest among all surfaces of the core 61. A plurality of water tubes are arranged in the core 61, and each of the water tubes is formed in a flat tubular shape by a thin plate member. Corrugated fins are connected to an outer wall surface of each water tube, for example, by brazing. With such a structure, the coolant introduced from the water supply pipe 62*a* is supplied to each water tube to cool high-temperature intake air, and the coolant warmed up by cooling the intake air is led out from each water tube via the drain pipe 62*b*. Additionally, by providing the corrugated fins, the surface area of each water tube is increased to improve the heat radiation effect.

As illustrated in FIGS. 6 to 8, the core connecting part 62 is a thin rectangular plate member attached to a right surface of the core 61, and connects the water supply pipe 62*a* and the drain pipe 62*b* to the water tubes. The core connecting part 62 defines a right surface of the intercooler 60 and a right-side wall of an accommodation space S1.

The cooler housing 63 forms the accommodation space S1, a flow path interposed between the second passage 35 and the third passage 36 in the intake passage 30, and a flow path where the bypass passage 80 and the intake passage 30 merges with each other. For example, the cooler housing 63 is disposed below the casing 52 of the supercharger 50 with the given space I2 (see FIG. 9) from the attaching surface 10*a* similarly to the casing 52. Further, the cooler housing 63 is formed in a substantially box shape, and a rear surface thereof faces the attaching surface 10*a*. The cooler housing 63 is provided with a housing main body 64 defining the accommodation space S1, and a merging part 65 connected to a downstream end of the bypass passage 80 and where the intake air passed through the bypass passage 80 merges with the intake air cooled by the core 61.

The housing main body 64 is formed in a thin rectangular box shape extending along the attaching surface 10*a* and opening at front and rear surfaces. The downstream end of the second passage 35 is connected to a front-surface opening 64*a*, and an upstream end of the third passage 36 is connected to a rear-surface opening 64*b*. Further, the housing main body 64 also opens at a right surface. A right-surface opening 64*c* is formed as an insertion port from which the core 61 is inserted to be accommodated inside the housing main body 64, and is closed by the core connecting part 62. The accommodation space S1 is defined by a top wall 64*d*, a bottom wall 64*e*, and a left side wall 64*f* of the housing main body 64, and the core connecting part 62. As described below, the bottom wall 64*e* and the left side wall 64*f* also define an inner wall of the merging part 65.

Thus, as indicated by an arrow A3 in FIGS. 8 and 9, the intake air passed through the second passage 35 flows into the housing main body 64 from the front-surface opening 64*a*, and flows rearwardly. Here, the intake air passes through the core 61 while being cooled by the cooling water supplied to the water tubes. The cooled intake air flows out of the rear-surface opening 64*b* of the housing main body 64 and into the third passage 36.

As illustrated in FIGS. 5, 6, 8, and 9, the merging part 65 has an inlet portion 66 to which the downstream end of the bypass passage 80 is connected, and a communicating portion 67 for leading the intake air entered from the inlet portion 66 into the space S2 which is located downstream (rear side) of the accommodation space S1 in the cooling housing 63. The merging part 65 of this embodiment is made of resin.

As illustrated in FIGS. 5, 6, etc., the inlet portion 66 is provided in a lower part of a left surface of the intercooler 60 and is formed as a tubular portion protruding leftwardly from the lower part. An upstream end (left end) of the inlet portion 66 opens leftwardly and is connected to the downstream end of the bypass passage 80.

The communicating portion 67 extends along an outer surface of the left side wall 64*f* of the housing main body 64 and an outer surface of the bottom wall 64*e*, and is defined as a passage communicating with the space S2 which is located downstream of the core 61 in the intercooler 60. For example, a first communicating portion 67*a* extending in the up-and-down directions and communicating with a downstream end (right end) of the inlet portion 66 and a left section of the space S2 located rearward of the core 61 is formed in the communicating portion 67 on the outer side (left side) of the left side wall 64*f*. Further, a second communicating portion 67*b* extending in the left-and-right directions and communicating with a lower end of the first communicating portion 67*a* and a bottom section of the space S2 is formed in the communicating portion 67 on the outer side (lower side) of the bottom wall 64*e*. The first and second communicating portions 67*a* and 67*b* lead the intake air entered from the inlet portion 66 into the space S2. Note that the second communicating portion 67*b* partially bulges downwardly as illustrated in the vertical cross section in FIG. 9. This bulge enables a reduction of airflow resistance caused when the intake air flows through the second communicating portion 67*b*.

Thus, as indicated by an arrow A6 in FIG. 6, the intake air passed through the bypass passage 80 flows into the merging part 65 via the inlet portion 66, and reaches the communicating portion 67. Then the intake air flows to the rear side of the core 61 along the outer surfaces of the left side wall 64*f* and the bottom wall 64*e* of the housing main body 64, and then merges in the space S2, with the intake air passed through the core 61. For example, the intake air that has reached the communicating portion 67 from the bypass passage 80 flows downwardly along the first communicating portion 67*a* and then flows rightwardly along the second communicating portion 67*b*, so as to merge in the space S2 by flowing rightwardly along the second communicating portion 67*b* (see an arrow A8 in FIGS. 6 and 9) or flowing rearwardly along the first communicating portion 67*a* (see an arrow A7 in FIG. 8).

The bypass passage 80 is formed in a curved tubular shape extending rightwardly after extending downwardly, the upstream end (upper end) thereof is formed by a valve body 80*a* built therein with the bypass valve 81, and a portion thereof downstream of the valve body 80*a* is formed by a bypass passage main body 80*b* formed as a curved tube.

As illustrated in FIGS. 3 to 4, the valve body 80*a* is made of metal, formed in a short cylindrical shape, and arranged below the first passage 34 and on the front side of a position near a left end of the attaching surface 10*a*, to open in the up-and-down directions at both ends. An upstream end (upper end) of the valve body 80*a* is connected to the branch part 34*c* of the first passage 34, and a downstream end (lower end) of the valve body 80*a* is connected to the upstream end of the bypass passage main body 80*b*.

The bypass passage main body 80*b* connects the branch part 34*c* of the first passage 34 to the merging part 65 of the cooler housing 63. For example, the bypass passage main body 80*b* is formed as an elbow-shaped curved tube made of resin, and adjacently arranged on the left side of the intercooler 60 at a position downward of the first passage 34 and the valve body 80*a*, so as to open upwardly and rightwardly. Similar to the valve body 80*a*, the bypass passage main body 80*b* is disposed on the front side of a position near the left end of the attaching surface 10*a*. The upstream end (upper end) of the bypass passage main body 80*b* is connected to the downstream end of the valve body 80*a*, and a downstream end (right end) of the bypass passage main body 80*b* is connected to the inlet portion 66 of the merging part 65.

Thus, as indicated by the arrow A6 in FIG. 6, the intake air branched from the first passage 34 and flowed into the bypass passage 80 passes through the bypass valve 81 built in the valve body 80*a*, and flows into the bypass passage main body 80*b*. The air flowed into the bypass passage main body 80*b* flows downwardly then rightwardly, and further flows into the merging part 65 via the inlet portion 66.

Figure 10:
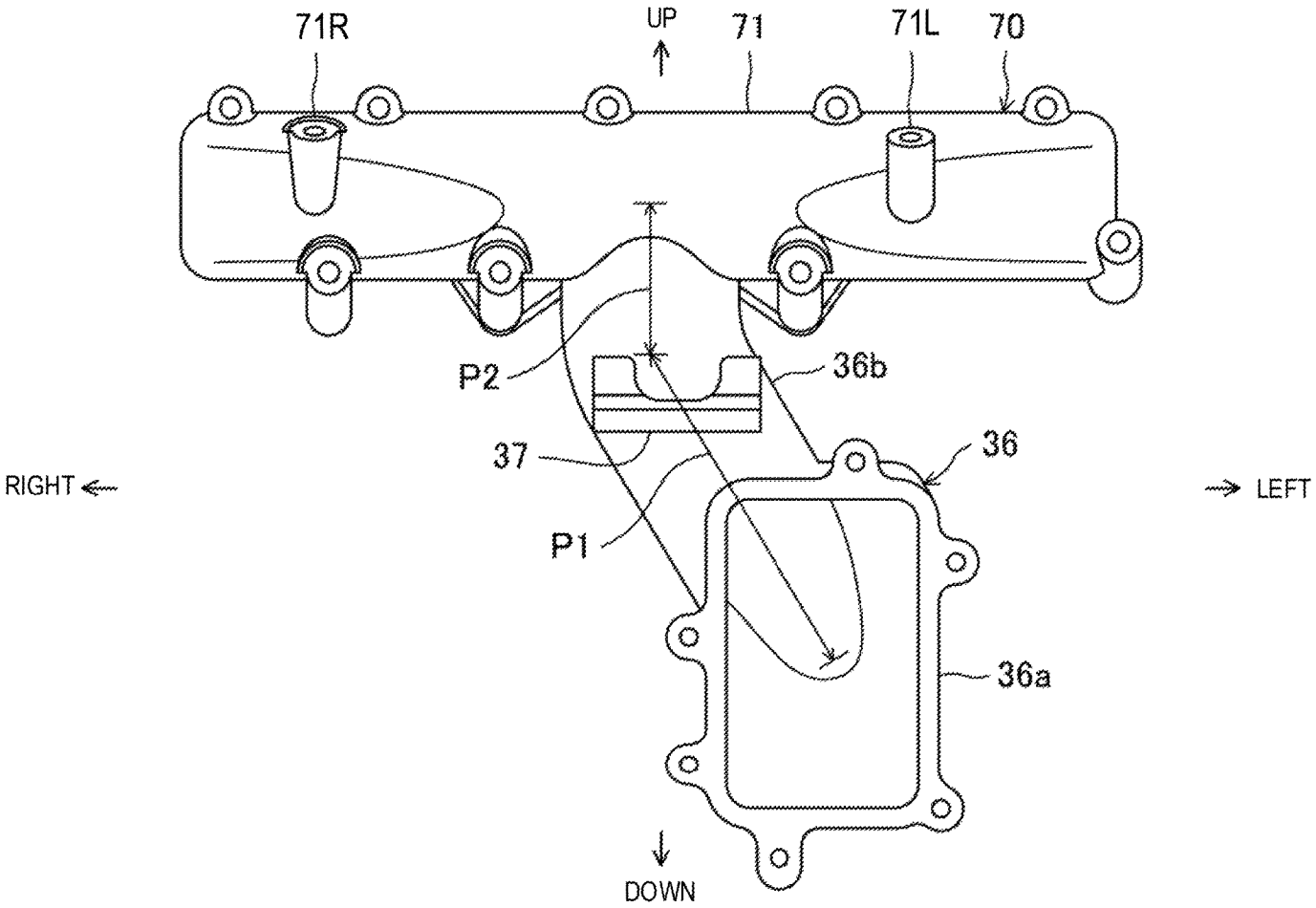
FIG. 10 is a front elevational view illustrating a third passage and a distribution passage.
Figure 11:
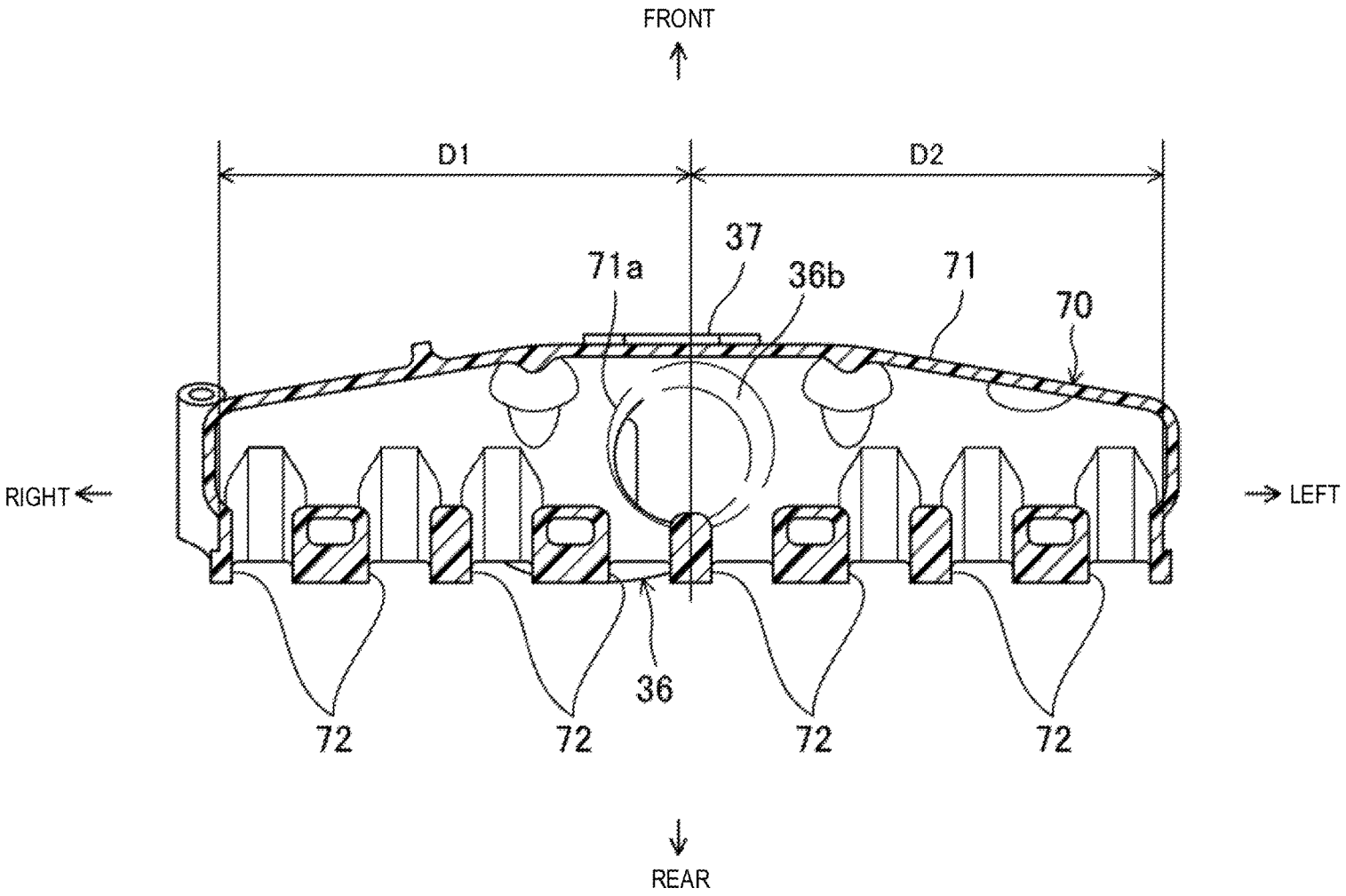
FIG. 11 is a horizontal cross-sectional view of the distribution passage.
Figure 12:
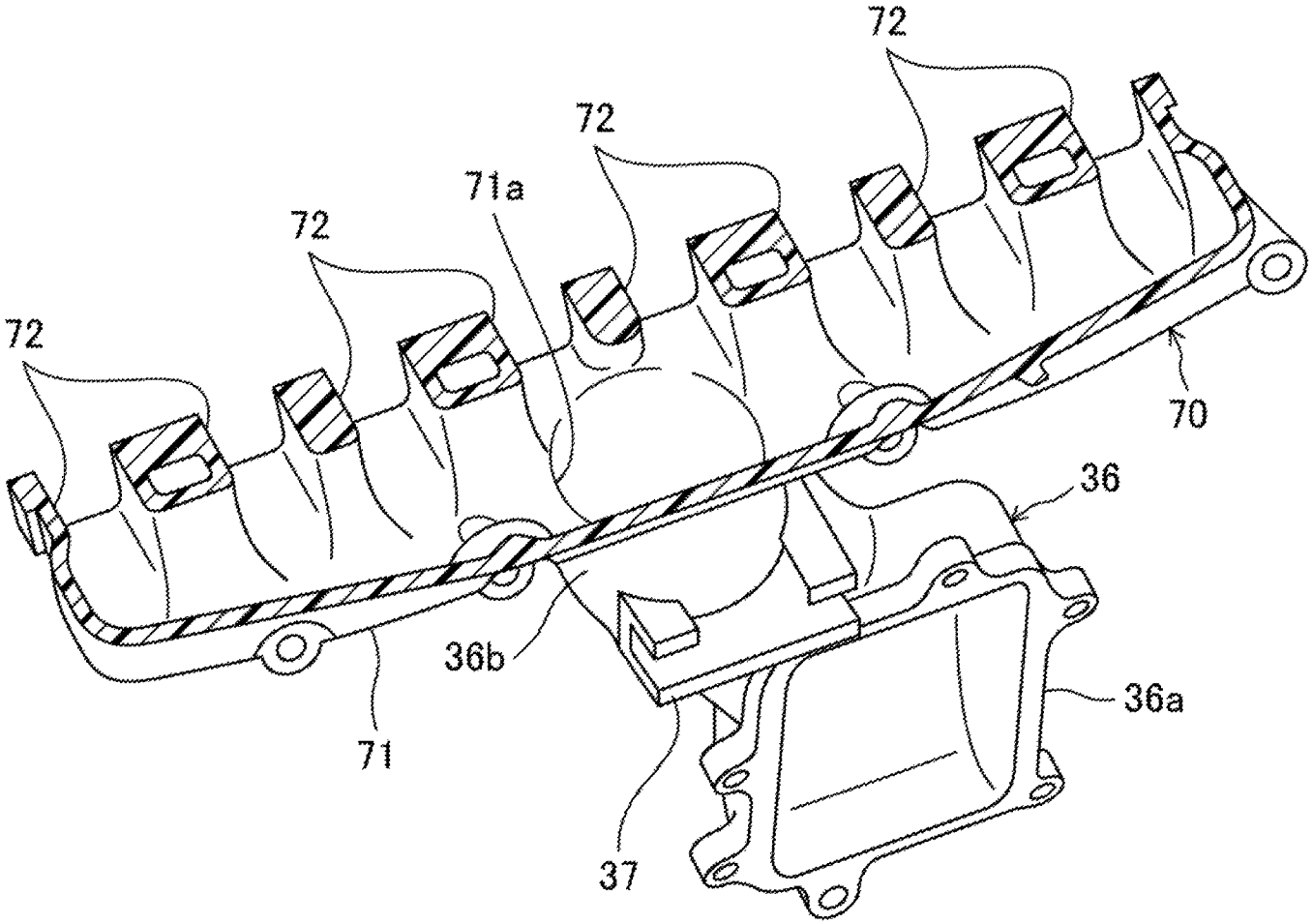
FIG. 12 is a perspective view illustrating the distribution passage partially horizontally cut out.

FIG. 10 is a front elevational view illustrating the third passage 36 and the distribution passage 70. FIG. 11 is a horizontal cross-sectional view of the distribution passage 70. FIG. 12 is a perspective view illustrating the distribution passage 70 partially horizontally cut out.

The third passage 36 is a resin member integrally formed with the distribution passage 70 and connects the intercooler 60 with the distribution passage 70 as illustrated in FIGS. 6 and 9. For example, the third passage 36 has, in the following order from the upstream side, a manifold portion 36*a* fastened to the cooler housing 63 and into which the intake air passed through the intercooler 60 and the intake air passed through the bypass passage 80 flow, and an introducing portion 36*b* leading to the distribution passage 70 the intake air collected in the manifold portion 36*a*. As illustrated in FIGS. 10 to 12, a supporting part 37 which is fastened to the center brackets 52C of the casing 52 is provided on a front surface of the third passage 36 near the boundary between the manifold portion 36*a* and the introducing portion 36*b*.

As illustrated in FIG. 8, the manifold portion 36*a* is formed in a box shape opening at a front (i.e., cooler housing 63 side) surface and having a short dimension in the front-and-rear directions, and the opened portion is connected to the rear-surface opening 64*b* of the housing main body 64. As illustrated in FIG. 9 etc., the manifold portion 36*a* is located between the rear surface of the housing main body 64 and the attaching surface 10*a* of the engine body 10. Further, a rear surface of the manifold portion 36*a* is connected to an upstream end of the introducing portion 36*b*.

The introducing portion 36*b* is formed as a curved tube extending substantially in the up-and-down directions, connected to the rear surface of the manifold portion 36*a* at an upstream end, and also connected to a lower center portion 71*a* of the surge tank 71 at a downstream end (see FIGS. 11 and 12). As illustrated in FIG. 9 etc., the introducing portion 36*b* extends along the gap between the part extending from the rear surface of the manifold portion 36*a* to the rear surface of the casing 52 and the attaching surface 10*a* of the engine body 10.

For example, as illustrated in FIG. 10, an upstream section of the introducing portion 36*b* (corresponding to a section P1 in FIG. 10) extends obliquely rightwardly and upwardly from the connected position with the manifold portion 36*a*, and a downstream section of the introducing portion 36*b* (corresponding to a section P2 in FIG. 10) extends right upwardly from an upper end of the upstream portion to the connected position with the surge tank 71.

As illustrated in FIG. 9, etc., the supporting part 37 allows a bolt to pass therethrough in the left-and-right directions, and supports the inserted bolt from the lower side. When the supercharger 50 is attached at a given attachment position, the center brackets 52C of the casing 52 interpose the supporting part 37 therebetween in the left-and-right directions. By fitting a single bolt into the bolt insertion hole of the center brackets 52C and the supporting part 37 in this state, the casing 52 (as a result, the supercharger 50) is fastened to the third passage 36. Thus, the third passage 36 supports the supercharger 50 via the fitted bolt. The third passage 36 constitutes the "intervening part" of this embodiment.

As illustrated in FIGS. 4 to 6 and 10 to 12, the distribution passage 70 has the surge tank 71 extending in the left-and-right directions, and the eight independent passages 72 formed on the rear side of the surge tank 71 and connected to the intake ports 16, respectively. As illustrated in FIG. 4, etc., the distribution passage 70 is located between the supercharger 50 and the engine body 10, for example, between the rear surface of the casing 52 and the attaching surface 10*a* of the engine body 10. The distribution passage 70 constitutes the "intervening part" of this embodiment. A right end side fastening part 71R to which the right end side bracket 52R provided to the casing 52 of the supercharger 50 is fastened and a left end side fastening part 71L to which the left end side bracket 52L is fastened are provided to a side surface of the surge tank 71 opposite from the engine body 10 (the front surface of the surge tank 71).

The surge tank 71 extends in the left-and-right directions from the disposed position of the intake port 16 corresponding to the first cylinder 18*a* to the disposed position of the intake port 16 corresponding to the fourth cylinder 18*d*, and is formed in a bottomed cylindrical shape closed on both ends in the left-and-right directions. Further, as illustrated in FIG. 12, the downstream end of the introducing portion 36*b* is connected to a lower surface of the surge tank 71. For example, an extending direction of a downstream portion of the introducing portion 36*b* perpendicularly intersects with the extending direction of the surge tank 71. The downstream portion of the introducing portion 36*b* is connected to a center part of the lower surface of the surge tank 71 in the left-and-right directions. In the surge tank 71, a dimension D1 from the connected part with the introducing portion 36*b* to one end in the left-and-right directions, is equal to a dimension D2 from the connected part to the other end in the left-and-right directions (D1=D2). By this structure, the distribution performance of the intake air is secured, which is advantageous in reducing the difference in intake efficiency between the cylinders.

The eight independent passages 72 are formed in an engine-body-side surface (rear surface) of the surge tank 71. Each of the eight independent passages 72 is formed as a passage extending in the front-and-rear directions, communicates with the space inside of the surge tank 71 at one end, and opens to the engine body side (rear side) at the other end. The eight independent passages 72 are located at positions corresponding to the eight intake ports 16, respectively. By fastening the distribution passage 70 to the cylinder block 11, the distribution passage 70 becomes communicable with the cylinders 18 via the intake ports 16.

Thus, the intake air flowed into the third passage 36 from the intercooler 60 passes through the manifold portion 36*a* (see an arrow A4 in FIG. 9), and then flows obliquely rightward and upward along the upstream section (section P1) of the introducing portion 36*b*, and flows directly upward along the downstream section (section P2) of the introducing portion 36*b*. Then, the intake air further flows into the substantially center of the surge tank 71 in the left-and-right directions, is temporarily accumulated in the surge tank 71, and is then supplied from the independent passages 72 to the respective cylinders 18 (see an arrow A5 in FIG. 9).

Figure 14:
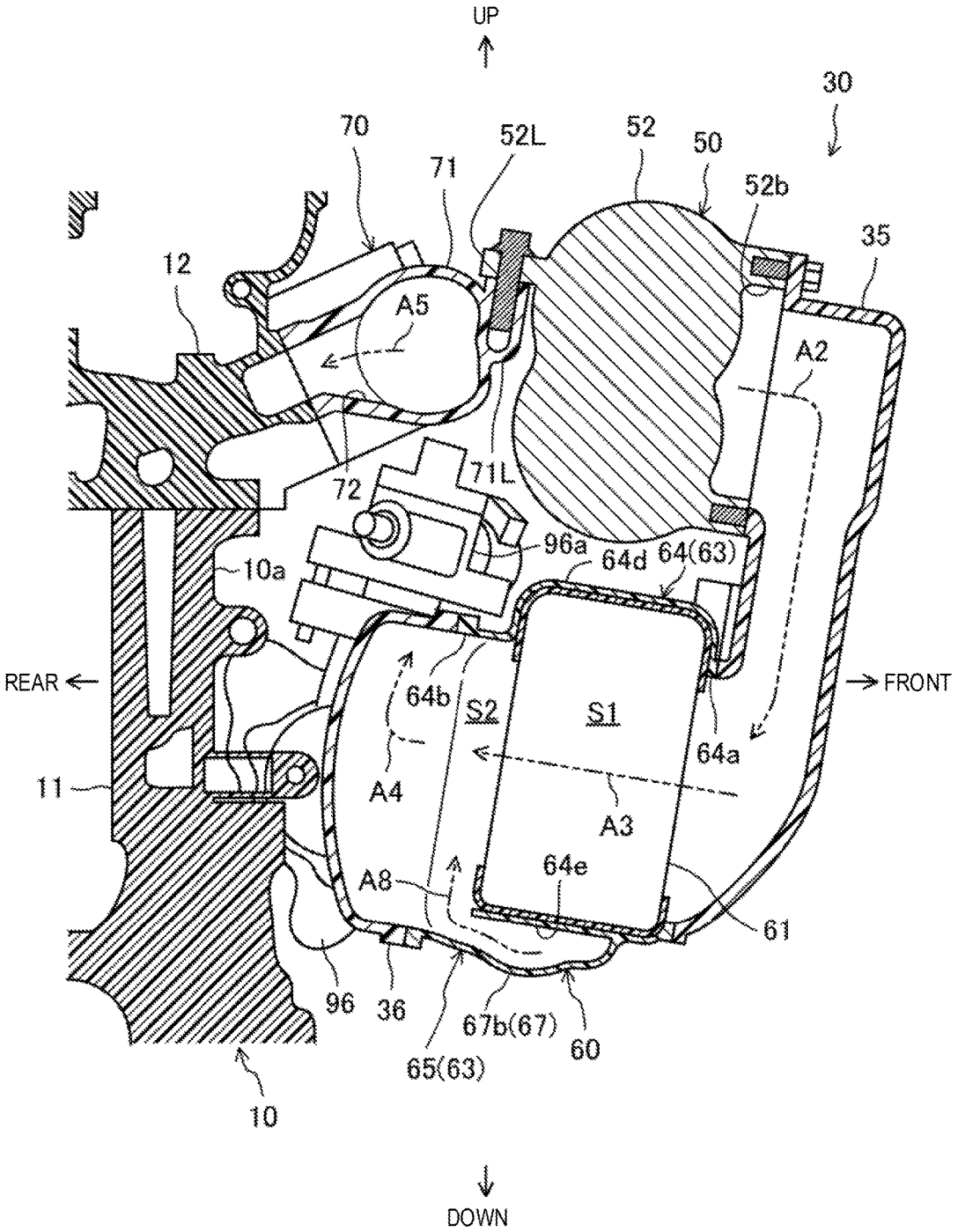
FIG. 14 is a vertical cross-sectional view illustrating arrangement of the fuel pump.

Here, as illustrated in FIGS. 4, 14, etc., each of the right and left end side fastening parts 71R and 71L is provided with a bolt insertion portion extending in cylinder axial directions (up-and-down directions). When the supercharger 50 is disposed at the above-described attachment position, the right end side bracket 52R is placed on the right end side fastening part 71R, and the left end side bracket 52L is placed on the left end side fastening part 71L. In this state, a bolt is fitted into the bolt insertion hole of the right end side bracket 52R and the bolt insertion portion of the right end side fastening part 71R, and another bolt is fitted into the bolt insertion hole of the left end side bracket 52L and the bolt insertion portion of the left end side fastening part 71L, so that the casing 52 (as a result, the supercharger 50) is fastened to the distribution passage 70. Thus, the supercharger 50 is supported by the distribution passage 70 via the fitted bolts.

In the intake passage 30 of this embodiment, the intake air purified by the air cleaner 31 flows into the first passage 34. Here, whether to flow the intake air into the bypass passage 80 is switchable by opening and closing the bypass valve 81. When the bypass valve 81 is closed, the intake air flowed into the first passage 34 is led from the first passage 34 to the supercharger 50 and compressed within the supercharger 50. The compressed intake air is discharged to the second passage 35, is cooled while passing through the core 61 of the intercooler 60, and then reaches the third passage 36. On the other hand, when the bypass valve 81 is opened, the intake air bypasses the supercharger 50 and the core 61 by passing through the bypass passage 80 branched from the intermediate position of the first passage 34. The intake air passed through or bypassed the supercharger 50 etc. passes through the space S2, is led to the distribution passage 70 via the third passage 36, and is distributed to the eight independent passages 72.

Here, as indicated by the arrow A4 in FIG. 6, the intake air led to the distribution passage 70 via the bypass passage 80 flows along a flow path curving in a downwardly convex shape. This flow path is effective in reducing the flow resistance of the intake air.

Next, the arrangement of peripheral parts of the intake passage 30, particularly the alternator 91, the air compressor 92, the starter motor 93, and the fuel pump 96 described above, is described.

As illustrated in FIGS. 2 to 3, near the right end (the left end in the sheets of FIGS. 2 and 3) of the attaching surface 10*a*, the drive pulley 53 constituting the supercharger 50, the alternator 91, and the air compressor 92 are arranged in this order from the upper side. For example, the alternator 91 is adjacently disposed on the right side of the intercooler 60, at a position near the right end of the front surface of the cylinder block 11. Further, the air compressor 92 is disposed at a height position between the alternator 91 and the oil pan 13. Both of the alternator 91 and the air compressor 92 are drivably coupled to the crankshaft 15 via the drive belt, and are operated by the drive force transmitted by the drive belt.

The starter motor 93 is disposed below the intercooler 60. For example, the starter motor 93 is arranged with its drive shaft oriented in the left-and-right directions, and as illustrated in FIG. 6 etc., is located below the core 61 via the second communicating portion 67*b*. The starter motor 93 is drivably coupled to the crankshaft 15 via an exclusive gear system, and drives the crankshaft 15 at the time of starting the engine 1.

The fuel pump 96 is fastened to be located on the same side of the engine 1 as various parts including the supercharger 50, that is, on the attaching surface 10*a* side. The fuel pump 96 of this embodiment is a plunger pump, has a cam (not illustrated) for driving the pump, and the cam is drivably coupled to the crankshaft 15 via an exclusive timing chain. The cam driven by the crankshaft 15 reciprocates the plunger via a tappet to pump the fuel. To drive the fuel pump 96, the intake camshaft may be used as conventionally known. However, with such a structure, if also a VVT (Variable Valve Timing) of the intake system is driven by the intake camshaft, the torque for driving the VVT becomes insufficient by the amount of torque required for driving the fuel pump 96, and normal operation of the VVT may become impossible. Driving the fuel pump 96 with the crankshaft 15 as in this embodiment achieves both the drive of the fuel pump 96 and the drive of the VVT by the intake camshaft, and is advantageous when using a high-pressure fuel pump as the fuel pump 96. Thus, a fuel injection amount is finely controlled, which reduces a fuel consumption of the engine. Additionally, with such a structure, the fuel pump 96 may be attached to a side surface of the engine body 10. In this case, since heat damage may be concerned if the side surface to attach the fuel pump 96 to is on the exhaust side, the fuel pump 96 is disposed on the intake side, near the intake-side side surface 10*a*.

Figure 13:
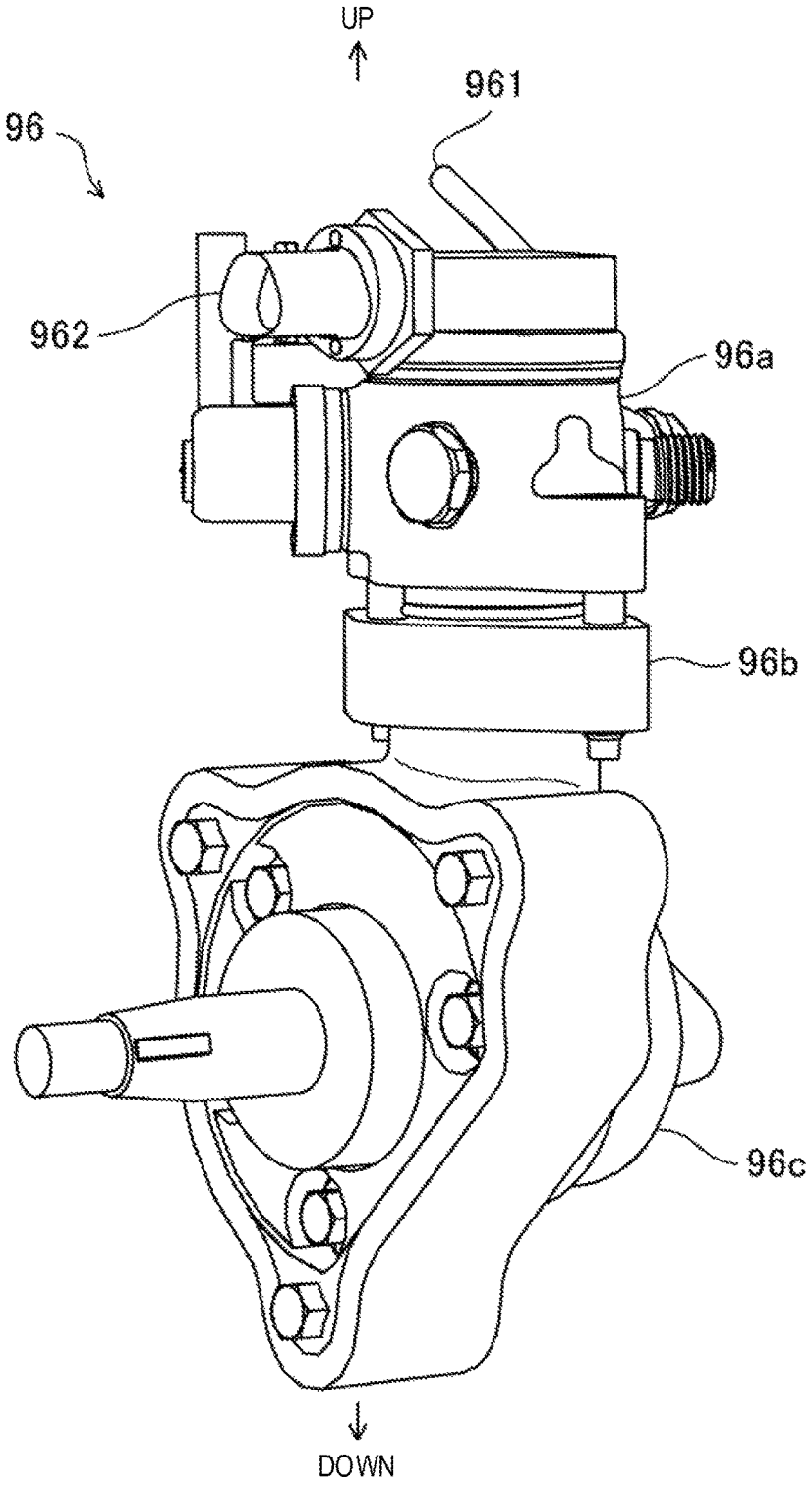
FIG. 13 is a perspective view illustrating a structure of a fuel pump.

FIG. 13 is a perspective view illustrating a structure of the fuel pump 96. FIG. 14 is a vertical cross-sectional view illustrating the arrangement of the fuel pump 96 seen in the crankshaft axial directions. As illustrated in FIG. 13, the fuel pump 96 is provided, in the following order, with a pump main body 96*a* having a suction port 961 and a discharge port 962 for the fuel and formed with a channel through which the fuel passes, a tappet accommodating part 96*b* accommodating the tappet to be movable in the up-and-down directions, and a cam accommodating part 96*c* rotatably accommodating the cam. The fuel pump 96 of this embodiment is attached so that the pump main body 96*a* is located on the upper side and the cam accommodating part 96*c* is located on the lower side. Further as illustrated in FIG. 14, the fuel pump 96 is attached to be located between the part extending from the intercooler 60 to supercharger 50 and the attaching surface 10*a* in the front-and-rear directions. Further, the height position of the pump main body 96*a* is between the supercharger 50 and the intercooler 60. Additionally, the attachment position of the fuel pump 96 in the left-and-right directions is adjacent on the left side of the third passage 36 as indicated by a chain line in FIG. 5.

Figure 15:
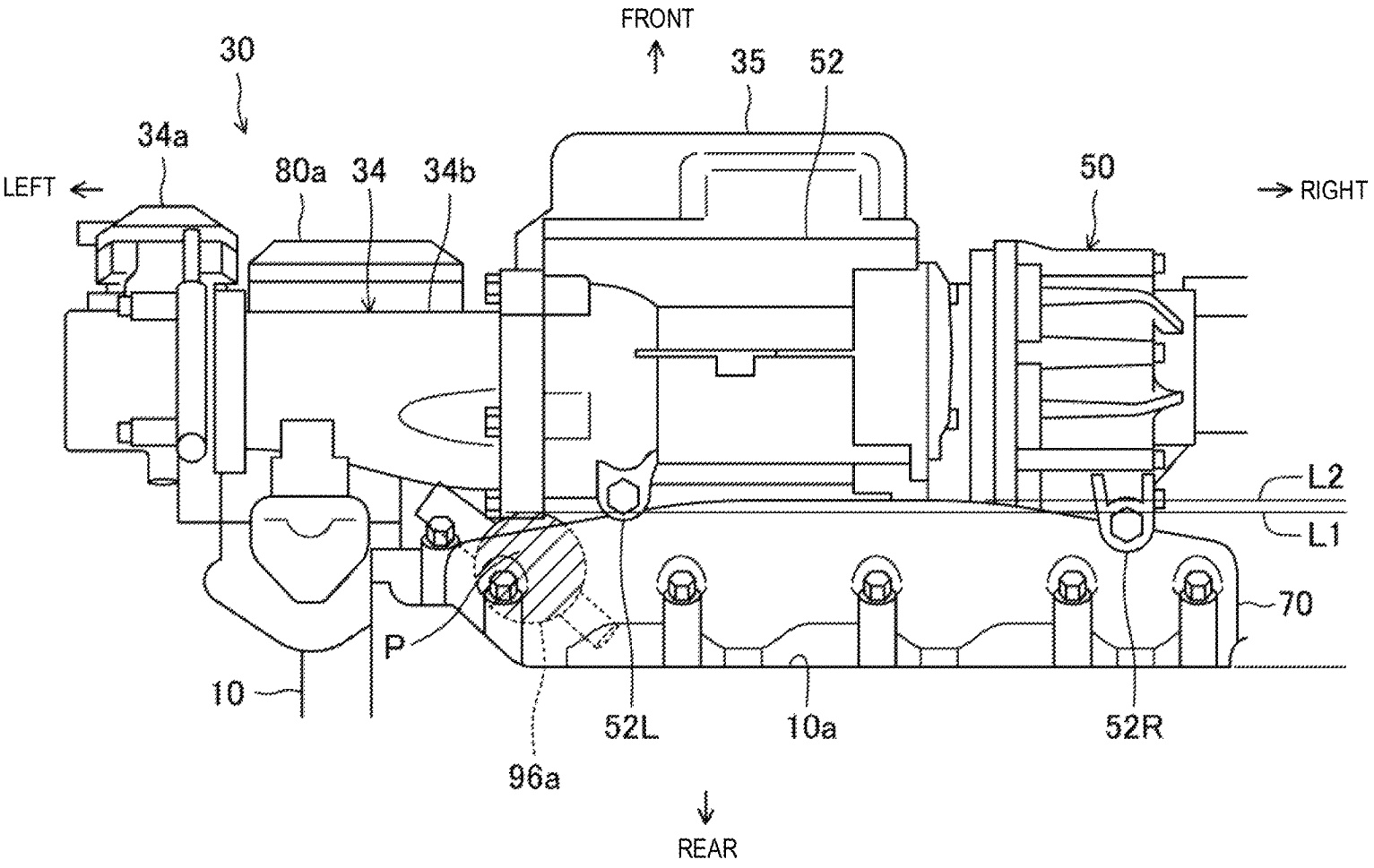
FIG. 15 is a view illustrating a positional relationship between the fuel pump and the distribution passage.

FIG. 15 is a view illustrating a positional relationship between the fuel pump 96 and the distribution passage 70. The distribution passage 70 overlaps with the fuel pump 96, particularly the pump main body 96*a* when the engine body 10 is seen from the upper side. For example, as indicated by a hatched portion in FIG. 15, the distribution passage 70 overlaps with a projected surface P of the pump main body 96*a* obtained by projecting the pump main body 96*a* onto a plane perpendicular to the up-and-down directions.

For example, when the engine body 10 is seen from the upper side, the rear side of the projected surface P overlaps with the distribution passage 70, and the front side of the projected surface P slightly protrudes from an outer edge of the distribution passage 70. A straight line L1 which is in contact with a front edge of the projected surface P and extends in the left-and-right directions is located on the engine body side of a straight line L2 which is in contact with a front edge of the distribution passage 70 and extends in the left-and-right directions. This means that although the pump main body 96*a* is not completely covered by the distribution passage 70, the pump main body 96*a*, including the uncovered portion, does not project forwardly (i.e., to the side opposite from the engine body 10) from the distribution passage 70.

For example, when the vehicle on which the engine 1 having the above structure is mounted causes a front collision, the collision load is applied to the engine 1 from the front side. A portion of the load which is applied from the front side of the supercharger 50 acts on the supercharger 50 via the second passage 35. Although the load moves the supercharger 50 rearwardly, i.e., to the engine body 10 side (e.g., the attaching surface 10*a* of the engine body 10) in relation to the vehicle, since the distribution passage 70 is provided between the supercharger 50 and the cylinder block 11, the supercharger 50 comes into contact with the distribution passage 70. Thus, the approach between the supercharger 50 and the engine body 10 is limited by the distribution passage 70.

On the other hand, the distribution passage 70 overlaps with the pump main body 96*a* when the engine body 10 is seen from the upper side. Such an arrangement locates the pump main body 96*a* between the supercharger 50 and the engine body 10 when the engine 1 is seen from the upper side, similar to the distribution passage 70. Therefore, the limitation of the approach between the supercharger 50 and the engine body 10 by the distribution passage 70 prevents the contact between the supercharger 50 and the pump main body 96*a*, which leads to protecting the fuel pump 96 from the supercharger 50.

Further, according to the above structure, the supercharger 50 and the fuel pump 96 may be brought close to each other in the up-and-down directions without separating them from each other, which is effective in reducing the size of the engine 1.

Thus, according to the above structure, the fuel pump 96 is protected from the supercharger 50 while reducing the size of the engine 1.

Further according to the above structure, by utilizing the distribution passage 70 which is a portion of the intake passage 30, the fuel pump 96 is protected from the supercharger 50 without providing another member, which is effective in reducing the number of components of the engine 1.

The fuel pump 96 of this embodiment is attached in a posture in which the pump main body 96*a* is arranged on the upper side and the cam accommodating part 96*c* is arranged on the lower side in the vertical directions. In such a posture, the tappet accommodating part 96*b* and the cam accommodating part 96*c* through which the fuel does not flow are downwardly spaced apart from the distribution passage 70, and the pump main body 96*a* through which the fuel flows is located directly below the distribution passage 70. Such an arrangement enables more reliable protection of the pump main body 96*a*, which is a member preferentially be protected over the other members 96*b* and 96*c*, by the distribution passage 70.

The straight line L1 contacting with the front edge of the projected surface P is located on the engine body side of the straight line L2 contacting with the front edge of the distribution passage 70. Thus, the pump main body 96*a* does not protrude forward (to the side opposite from the engine body 10) from the distribution passage 70. As a result, the distribution passage 70 protects the pump main body 96*a* from the supercharger 50 without completely covering the pump main body 96*a*. Further, when the supercharger 50 is in contact with the distribution passage 70, the above structure is advantageous in reliably preventing the contact between the supercharger 50 and the pump main body 96*a*.

The distribution passage 70 is attached to the engine body 10. Disposing such a passage near the engine body 10 is advantageous in reducing the size of the engine 1.

The second passage 35 is connected to the part of the supercharger 50 on the opposite side from the engine body 10. Therefore, when the collision load is received from the opposite side of the engine body 10 (front side), the load is added to the supercharger 50 via the second passage 35. Since the second passage 35 is a hollow member, it crushes according to the magnitude of the load. By crushing the second passage 35, the impact applied to the supercharger 50 itself is subsided. Thus, the relative movement of the supercharger 50 is reduced, which becomes advantageous in reliably protecting the fuel pump 96.

By fastening the supercharger 50 to the distribution passage 70, the distribution passage 70 supports the supercharger 50. Therefore, when the collision load is applied to the supercharger 50, the approach between the supercharger 50 and the engine body 10 is limited more reliably by the distribution passage 70, which is advantageous in reliably protecting the fuel pump 96.

The supercharger 50 extends in the left-and-right directions along the attaching surface 10*a* of the engine body 10 and the left and right end sides of the supercharger 50 are fastened to the distribution passage 70 by the right and left end side brackets 52R and 52L, respectively. Thus, the supercharger 50 is stably supported. Therefore, the approach between the supercharger 50 and the engine body 10 is stably limited, which is advantageous in reliably protecting the fuel pump 96.

In each of the right and left end side brackets 52R and 52L, the bolt is inserted in the up-and-down directions. Thus, for example, compared with a structure in which the bolt is inserted in the front-and-rear directions, a wide contact surface between the supercharger 50 and the distribution passage 70 is secured, which is advantageous in stably supporting the supercharger 50.

Other Embodiments

The above embodiment may be modified as follows.

In the above embodiment, the engine 1 is the transverse four-cylinder engine; however, without limiting to this, the number of the cylinders may be three, five or more. Further, the engine 1 may be a vertical engine. In this case, the intake passage 30 and the fuel pump 96 are disposed on one of left and right side surfaces of the engine body 10.

Further in the above embodiment, the supercharger 50 is the mechanically driven supercharger; however, without limiting to this, it may be an electric supercharger.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Supercharged Engine
10 Engine Body
10*a* Attaching Surface (Intake-side Side Surface)
16 Intake Port
18 Cylinder
30 Intake Passage
35 Second Passage (Relay Part)
50 Supercharger
70 Distribution Passage (Intervening Part)
96 Fuel Pump

What is claimed is:

1. A supercharged engine, comprising:

an engine body having cylinders;

an intake passage disposed outside the engine body and connected to the cylinders via intake ports;

a supercharger provided in the intake passage and spaced apart from an intake-side side surface of the engine body, the intake-side side surface being connected to the intake passage; and a fuel pump disposed on the intake-side side surface, wherein a portion of the intake passage constitutes an intervening part that extends along the intake-side side surface of the engine body located between the supercharger and the engine body, the intervening part overlaps with the fuel pump in a front-rear direction as seen from a top of the engine body, the supercharger extends along the intake-side side surface, and the supercharger is fastened to the intervening part at two opposite end sides.

2. The engine of claim 1, wherein the intervening part is formed by a portion of the intake passage downstream of the supercharger.

3. The engine of claim 2, wherein the intake passage has a relay part constituting a passage downstream of the supercharger and upstream of the intervening part, and the relay part is connected to a part of the supercharger on a side opposite from the engine body.

* * * * *